US009929472B2

(12) United States Patent
Rojanski et al.

(10) Patent No.: US 9,929,472 B2
(45) Date of Patent: Mar. 27, 2018

(54) PHASED ARRAY ANTENNA

(71) Applicants: ISRAEL AEROSPACE INDUSTRIES LTD., Lod (IL); Ana Starovolski, Ganey Tikva (IL)

(72) Inventors: Vladimir Rojanski, Petach-Tikva (IL); Aharon Starovolski

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 728 days.

(21) Appl. No.: 14/385,360

(22) PCT Filed: Mar. 6, 2013

(86) PCT No.: PCT/IL2013/050203

§ 371 (c)(1),
(2) Date: Sep. 15, 2014

(87) PCT Pub. No.: WO2013/136325

PCT Pub. Date: Sep. 19, 2013

(65) Prior Publication Data

US 2015/0084814 A1 Mar. 26, 2015

(30) Foreign Application Priority Data

Mar. 14, 2012 (IL) ..... 218625

(51) Int. Cl.
*H01Q 13/10* (2006.01)
*H01Q 1/38* (2006.01)
(Continued)

(52) U.S. Cl.
CPC ..... *H01Q 13/10* (2013.01); *H01Q 1/38* (2013.01); *H01Q 1/42* (2013.01); *H01Q 3/34* (2013.01);
(Continued)

(58) Field of Classification Search
USPC ..... 343/767, 754, 770, 702; 342/368
See application file for complete search history.

(56) References Cited

U.S. PATENT DOCUMENTS 5,087,920 A 2/1992 Tsurumaru
6,252,556 B1 * 6/2001 Ito ..... H01Q 9/0428 343/700 MS
(Continued)

FOREIGN PATENT DOCUMENTS

WO 2004079861 A1 9/2004
WO 2011051931 A1 5/2011

OTHER PUBLICATIONS

International Search Report. dated Aug. 12, 2013. Application No. 2013050203.
(Continued)

*Primary Examiner* — Jessica Han
*Assistant Examiner* — Hai Tran
(74) *Attorney, Agent, or Firm* — Browdy and Neimark, P.L.L.C.

(57) ABSTRACT

An antenna element having a vertically stacked structure and a phased array antenna that includes a plurality of antenna elements sharing a common conductive ground plane are described. The phased array antenna also includes a common conductive shell electrically coupled to the common conductive ground plane and extending away there from to encompass the antenna elements. The common conductive shell and the common conductive ground plane together define a common cavity having a common aperture. The phased array antenna also includes a common dielectric superstrate layer disposed over the common cavity at a predetermined distance from the antenna elements and a beam steering system coupled to the antenna elements and configured for steering an energy beam produced by the phased array antenna.

19 Claims, 12 Drawing Sheets

(51) Int. Cl.

| | |
|---|---|
| ***H01Q 1/42*** | (2006.01) |
| ***H01Q 3/34*** | (2006.01) |
| ***H01Q 9/04*** | (2006.01) |
| ***H01Q 21/06*** | (2006.01) |

(52) U.S. Cl.
CPC ..... *H01Q 9/0414* (2013.01); *H01Q 21/065* (2013.01)

(56) References Cited

U.S. PATENT DOCUMENTS

| | | | | |
|---|---|---|---|---|
| 6,295,028 | B1 * | 9/2001 | Jonsson | H01Q 1/246 343/700 MS |
| 6,992,621 | B2 * | 1/2006 | Casas | H01Q 1/246 342/373 |
| 2008/0218418 | A1 * | 9/2008 | Gillette | H01Q 1/38 343/700 MS |
| 2010/0277374 | A1 * | 11/2010 | Ju | H01Q 15/0086 343/700 MS |

OTHER PUBLICATIONS

Miguel A. Gonzalez et al "Analysis of Cabity-Backed Multilayer Microstrip Patch Arrays on Continuous Dielectric Substrates by a Hybird Modular Technique" 31st European Microwave Conference—London, XP-001044892. 269-272 (2001).

Miguel A. Gonzalez et al "Broad-Brand Cavity-Backed and Capacitively Probe-Fed Microstrip Patch Arrays" IEEE Tansactions on Antennas and Propagation. 48:5:784-789 (May 2000).

* cited by examiner

PHASED ARRAY ANTENNA

FIELD OF THE INVENTION

The present invention relates generally to directional beam forming antennas, and in particular, to a phased array antenna configuration.

BACKGROUND OF THE INVENTION

There are many applications employing antennas for transmitting and receiving electromagnetic signals in which antenna gain patterns with maxima for directional transmitting and receiving the signals is a desirable feature. One type of such antenna systems is an active Electronically Steered Phased Array (AESPA) having a plurality of individual antenna elements which are interconnected to enable electronic steering of the radiated beams of electromagnetic energy in space without physical movement of the whole array. The antenna elements in an array can be distributed either uniformly or non-uniformly over a prescribed surface area, and configured to provide the desired antenna radiation characteristics. The surface area of the phased array antenna may be either planar or curved. When desired, the antenna elements can be arranged in one or more planes. A circumference of the area may have any shape, e.g., circular, rectangular, or simply a straight line. Phased array antennas can, for example, be used in radar systems for estimating the direction-of-arrival of a target.

SUMMARY OF THE INVENTION

There is still a need in the art to provide a phased array antenna in which individual radiating antenna elements occupy rather small physical areas, preferably less than half of the operating wavelength, and have a substantial internal impedance matching level over a wide frequency band.

It would be advantageous to have a phased array antenna having radiation efficiency within a wide region of spatial angles.

There is also a need and it would be useful to have a phased array antenna having enhanced inter-element isolation, i.e., a phased array antenna with reduced coupling between the antenna elements, especially at extreme deflection angles.

There is further a need and it would be useful to have a phased array antenna performing selective augmentation in a preferable scanning sector.

There is further a need and it would be useful to have a phased array antenna having intrinsic flexibility, in order to make it applicable through a wide range of antenna sizes and operational frequency choices.

According to one general aspect, the present application provides a novel phased array antenna.

According to some embodiments, the phased array antenna includes a plurality of antenna elements sharing a common conductive ground plane for all the antenna elements and spaced apart at a predetermined distance from each other. The phased array antenna also includes a common conductive shell electrically coupled to the common conductive ground plane. The common conductive shell extends away from common conductive ground plane and encompasses the antenna elements. The common conductive shell and the common conductive ground plane together define a common cavity having a common aperture. The phased array antenna further includes a common dielectric superstrate layer disposed over the common cavity at a predetermined distance from the plurality of antenna elements. The phased array antenna also includes a beam steering system coupled to the antenna elements and configured for steering an energy beam produced by the phased array antenna.

According to some embodiments, a shape of a front of the common aperture is selected from a circular shape, an oval shape, a polygonal shape, and a D-shape.

According to one embodiment, walls of the common conductive shell are perpendicular to said common conductive ground plane.

According to another embodiment, walls of the common conductive shell are inwardly tapered from the common conductive ground plane towards the common aperture of the common cavity.

According to a further embodiment, walls of the common conductive shell are outwardly tapered from the common conductive ground plane towards the common aperture of the common cavity.

According to some embodiments, the common dielectric superstrate layer is arranged at the common aperture of the common cavity.

According to some embodiments, the common cavity is filled with a dielectric material having a dielectric permittivity $\in_g$ equal to or greater than the dielectric permittivity of air.

A height $L_g$ of the gap in the common cavity between the common superstrate layer and a top of the plurality of antenna elements depends on the desired deflection angles θ of the radiation beam. For example, the height $L_g$ of the gap can be obtained by $$L_g \approx \begin{cases} \lambda_g\left(x+\frac{n}{2}\right), & \text{where } 0.6 \le x \le 0.65 \quad \text{for } 0° \le \theta \le 15° \\ \lambda_g(0.01\theta + 0.327 + 0.6n), & \text{for } 15° < \theta \le 45° \\ y\lambda_g, & \text{where } 0.45 \le y \le 0.5 \quad \text{for } 45° < \theta \le 70° \end{cases}$$

where $\lambda_g=\lambda_0/\sqrt{\in_g}$, and $\lambda_0$ is the wavelength corresponding to the central operation frequency of the phased array antenna, $\in_g$ is the dielectric permittivity of the dielectric material filling the gap in the common cavity, θ is the required deflection angle (in degrees), and n=0, 1, 2, . . . It should be noted that the case when n=0 is preferred.

According to some embodiments, thickness of the common dielectric superstrate layer (16) is uniform and complies with a relationship $L_{SL}\approx\lambda_{SL}(0.2+n/2)$, where $\lambda_{SL}=\lambda_0/\sqrt{\in_{SL}}$, and $\lambda_0$ is the wavelength corresponding to the central operation frequency of said phased array antenna, $\in_{SL}$ is the dielectric permittivity of the common dielectric superstrate layer (16), and n=0, 1, 2, . . .

According to some embodiments, a thickness of the common dielectric superstrate layer near walls of said common conductive shell is different than the thickness of the common dielectric superstrate layer at its center.

According to some embodiments, a side surface of the common dielectric superstrate layer is selected from a biplanar surface, biconcave surface, plano-concave surface, and convex-concave surface.

According to some embodiments, the common superstrate layer is made from a heat insulating material.

According to some embodiments, an outer surface of the common superstrate layer is covered with a heat insulating material.

According to some embodiments, each antenna element of the plurality of the antenna elements comprises a vertically stacked structure that includes an antenna element conductive shell extending away from and coupled to the common conductive ground plane. The antenna element conductive shell has a lumen to define an antenna element cavity having a bottom and an antenna element aperture.

The antenna element further includes a feeding radiator backed by the cavity and a parasitic radiator backed by the cavity and parasitically coupled to the feeding radiator. The feeding radiator is arranged at the bottom of the element cavity, whereas the parasitic radiator is disposed over and spaced apart from the feeding radiator.

The antenna element also includes a feed arrangement coupled to the feeding radiator and operable to provide radio frequency energy thereto.

According to some embodiments, each antenna element includes a bottom dielectric substrate. The bottom dielectric substrate can, for example, be common for all the antenna elements. However, when desired, at least a part of the antenna elements can have individual dielectric substrates separated from each other.

The bottom dielectric substrate has a bottom substrate underside having a lower bottom conductive coating adhesively bound thereto, and a bottom substrate upper side having an upper bottom conductive coating adhesively bound thereto. The lower bottom conductive coating and the upper bottom conductive coating are grounded; thereby forming the common conductive ground plane. The conductive shell of each antenna element is connected to said upper bottom conductive coating.

According to some embodiments, the feeding radiator includes a bottom slot arranged within the cavity in the upper bottom conductive coating to define a bottom feeding patch encompassed by the bottom slot.

According to some embodiments, each antenna element includes a top dielectric substrate which is common for all the antenna elements. The top dielectric substrate has a top substrate underside having a lower top coating adhesively bound thereto, and a top substrate upper side having an upper top coating adhesively bound thereto. The lower top coating is connected to the antenna element conductive shell.

According to one embodiment, the feeding radiator includes a top slot in the upper top coating to define a top radiating patch encompassed by the top slot.

According to another embodiment, the feeding radiator includes a top slot arranged within the cavity in the lower top coating to define a top radiating patch encompassed by the top slot.

According to some embodiments, the parasitic radiator for each antenna element is arranged at the antenna element aperture of the antenna element cavity.

According to some embodiments, each antenna element further comprises an intermediate layer sandwiched between the bottom dielectric substrate and the top dielectric substrate for providing a vertical separation and support to the bottom dielectric substrate and the top dielectric substrate. According to one example, the intermediate layer can be formed from a solid dielectric material. According to another example, the intermediate layer can be formed from a metal plate.

According to some embodiments, the feed arrangement for each antenna element includes a radio frequency (RF) coaxial line.

According to some embodiments, the feed arrangement for each antenna element includes an embedded microstrip feed line arranged within the bottom dielectric substrate.

According to some embodiments, the feed arrangement for each antenna element includes an microstrip feed line arranged on the bottom substrate underside of the bottom dielectric substrate.

According to some embodiments, the feed arrangement for each antenna element includes a strip feed line arranged within the bottom dielectric substrate.

For the purpose of the present application the term "microstrip line feed line" is referred to a type of electrical transmission line having a single conductor trace on one side of a dielectric substrate and a single ground plane on the opposite side. The term "stripline feed line" is referred to a type of electrical transmission line with a single conductor trace, which is sandwiched between two parallel ground planes. In this structure the insulated material is made up of two dielectric layers. The central conductor should not necessary be equally spaced between the ground planes. Generally, a dielectric material above the central conductor may be different than the dielectric material below the central conductor. The term "embedded microstrip feed line" is referred to a feed line that is similar to the microstrip feed line, however the conductor trace (signal line) is embedded in a dielectric. In this structure the dielectric is made up of two dielectric layers.

According to an embodiment, the feed arrangement includes a grounded layer of conductive material arranged within the bottom dielectric substrate. The grounded layer for each antenna element can include a corresponding opening arranged under the bottom feeding patch. According to this embodiment, the feed arrangement includes a plurality of microstrip feed lines arranged for each antenna element correspondingly within the bottom dielectric substrate to provide capacitive coupling for transferring RF energy between the micro strip feed line and the bottom feeding patch through the opening in the grounded layer.

According to some embodiments, the phased array antenna comprises a plurality of bottom encompassing vias connecting the conductive lower bottom coating mounted on the bottom substrate underside to the upper bottom coating mounted on the bottom substrate upper side.

According to some embodiments, the phased array antenna also comprises a plurality of top encompassing vias connecting the conductive lower top coating mounted on the top substrate underside to the upper top coating mounted on the top substrate upper side.

According to some embodiments, the phased array antenna also comprises a plurality of separating vias passing through at least the bottom dielectric substrate, the intermediate layer, and the top dielectric substrate. The separating vias connect the conductive lower bottom coating mounted on the bottom substrate underside to the upper top coating mounted on the top substrate upper side.

According to another general aspect, there is provided a novel antenna element having a vertically stacked structure. The antenna element comprises:

a bottom dielectric substrate, the bottom dielectric substrate having a bottom substrate underside having a lower bottom conductive coating adhesively bound thereto, and a bottom substrate upper side having an upper bottom conductive coating adhesively bound thereto;

an antenna element conductive shell extending away from the bottom substrate upper side and connected to said upper bottom conductive coating, the antenna element conductive shell having a lumen to define an antenna element cavity having an antenna element aperture;

a feeding radiator backed by the cavity, the feeding radiator including a bottom slot arranged within the cavity in said upper bottom conductive coating to define a bottom feeding patch encompassed by the bottom slot;

a top dielectric substrate common for all the antenna elements, said top dielectric substrate having a top substrate underside having a lower top coating adhesively bound thereto, and a top substrate upper side having an upper top coating adhesively bound thereto, said lower top coating being connected to said antenna element conductive shell;

a parasitic radiator backed by the cavity being disposed over and spaced apart from said feeding radiator, and parasitically coupled to said feeding radiator, said parasitic radiator including a top slot in said upper top coating to define a top radiating patch encompassed by the top slot; and an antenna element feed arrangement coupled to the feeding radiator and operable to provide radio frequency energy thereto.

According to some embodiments, shapes of the bottom feeding patch, the top radiating patch, antenna element aperture, and a cross-section of the antenna element conductive shell are selected from a round shape, oval shape, ring shape, polygonal shape, and D-shape.

The phased array antenna and the antenna element of the present invention has many of the advantages of the prior art techniques, while simultaneously overcoming some of the disadvantages normally associated therewith.

The phased array antenna of the present invention can generally be configured to operate in a broad band within the frequency range of about 100 MHz to 100 GHz.

The phased array antenna according to the present invention may be efficiently manufactured. The printed circuit part of the antenna elements can, for example, be manufactured by using printed circuit techniques.

The installation of the antenna elements and antenna array of the present invention is relatively quick and easy.

The phased array antenna and antenna element according to the present invention is of durable and reliable construction.

The phased array antenna according to the present invention may be readily conformed to complexly shaped surfaces and contours of a mounting platform.

There has thus been outlined, rather broadly, the more important features of the invention so that the detailed description thereof that follows hereinafter may be better understood, and the present contribution to the art may be better appreciated. Additional details and advantages of the invention will be set forth in the detailed description.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1A:
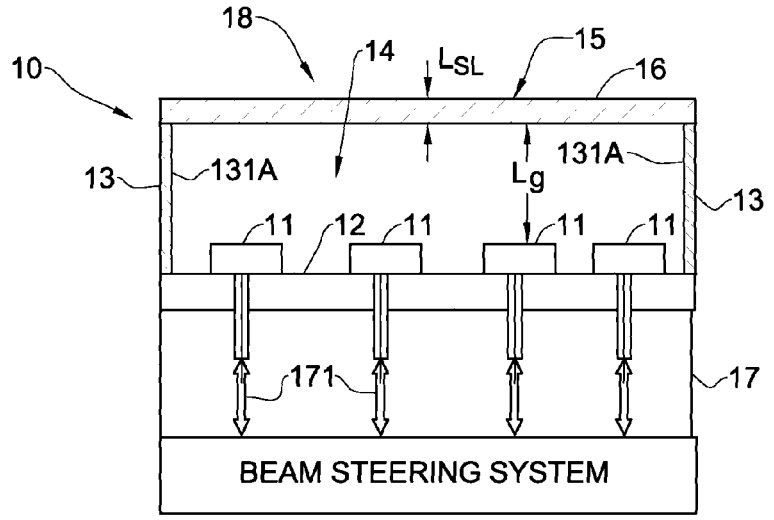
FIGS. 1A-1C are schematic side cross-sectional views of a phased array antenna, according to several embodiments of the present invention.

The principles and operation of a phased array antenna and the antenna elements according to the present invention may be better understood with reference to the drawings and the accompanying description. It should be understood that these drawings are given for illustrative purposes only and are not meant to be limiting. It should be noted that the figures illustrating various examples of the system of the present invention are not to scale, and are not in proportion, for purposes of clarity. It should be noted that the blocks as well other elements in these figures are intended as functional entities only, such that the functional relationships between the entities are shown, rather than any physical connections and/or physical relationships. The same reference numerals and alphabetic characters will be utilized for identifying those components which are common in the device and its components shown in the drawings throughout the present description of the invention.

Referring to FIG. 1A, a schematic side cross-sectional view of a phased array antenna 10 is illustrated, according to one embodiment of the present invention. The phased array antenna 10 includes a plurality of antenna elements 11 sharing a common conductive ground plane 12. The common conductive ground plane 12 is common for all the antenna elements 11. The antenna elements 11 are spaced apart at a predetermined distance from each other which is required either to eliminate the grating lobes from the visible zone or at least to adequately suppress the relative power of the grating lobes with respect to the main beam.

The phased array antenna 10 also includes a common conductive shell 13 for all the antenna elements that is electrically (e.g., galvanically) coupled to the common conductive ground plane 12. The common conductive shell 13 extends away from conductive ground plane 12 to encompass the plurality of the antenna elements 11. The common conductive shell 13 and the common conductive ground plane together define a common cavity 14 having a common aperture 15.

The phased array antenna 10 also includes a common dielectric superstrate layer 16 disposed over the common cavity 14. As shown in FIG. 1A, the common dielectric superstrate layer 16 is arranged at the common aperture 15, i.e. within the common cavity 14. However, when desired, the superstrate layer 16 can completely overlay the aperture 15 and be mounted on walls 131A of the common conductive shell 13.

According to an embodiment, a gap in the common cavity 14 between the antenna elements 11 and the superstrate layer 16 is filled with a dielectric material (not shown) having a dielectric permittivity $\in_g$ equal to or greater than the dielectric permittivity of air. In such a case, the dielectric material can be made of a solid material forming a support for supporting the superstrate layer 16.

Furthermore, the phased array antenna 10 also includes a beam steering system 17 coupled to the plurality of the antenna elements 11 and configured for steering an energy beam produced by the phased array antenna 10. The beam steering system is a known system that can, inter alia, include such components as a feeding arrangement shown schematically by a reference numeral 171 and configured for feeding the antenna elements 11. The beam steering system also includes T/R modules (not shown), Digital signal processing (DSP) driven switches (not shown), connectors, and other components required to control steerable multibeams.

It should be noted that the phase array antenna structure 10 can be implemented in various ways. As shown in FIG. 1A, the inner walls 131A of the common conductive shell 13 of the phased array antenna 10 are straight, i.e. perpendicular to the common conductive ground plane 12; however other configurations are also contemplated.

Figure 1B:
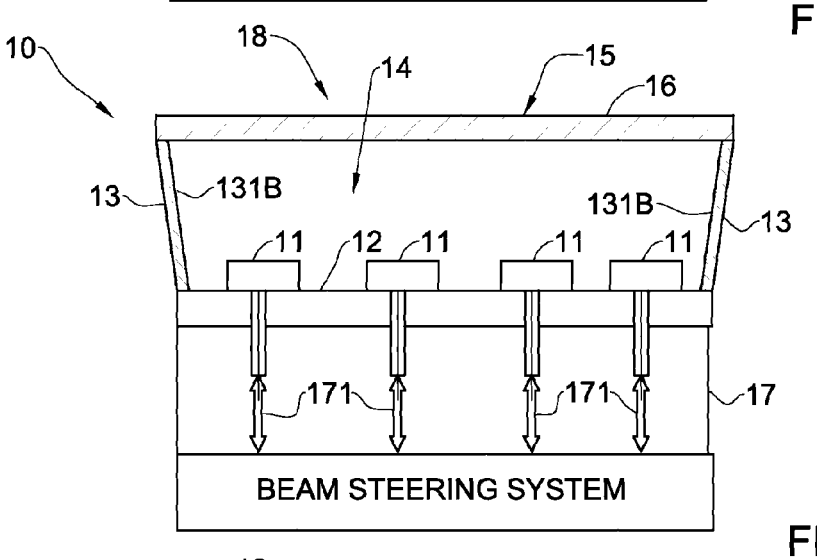
Figure 1C:
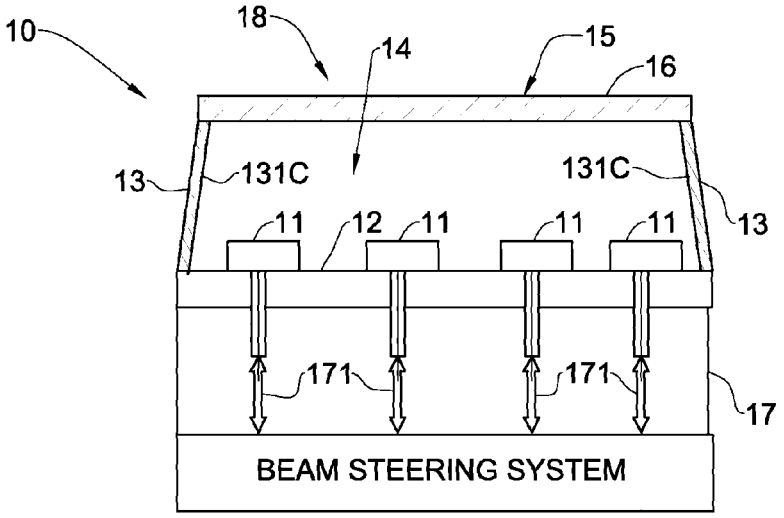

For example, FIGS. 1B and 1C illustrate, correspondingly, outwardly tapered and inwardly tapered walls of the common conductive shell 13 from the common conductive ground plane 12 towards the common aperture 15 of the common cavity 14.

For example, angles of the inwardly tapered wall and outwardly tapered wall are in the range of about 0 degrees to about 30 degrees. According to an embodiment, all of the walls 131B and 131C may be tapered. According to another embodiment (not shown), only a portion of the walls 131B and 131C may be tapered. When desired, distinct portions of the walls 131B and 131C may have different tapers.

The antenna elements 11 of phased array antenna 10 can be arranged in columns and rows, however other arrangements are also contemplated. A shape of a front of the common aperture 15 can take any desired shape, including, but not limited to, a circular shape, oval shape, D-shape polygonal shape (e.g., triangular, square, rectangular, quadrilateral, pentagon, hexagonal, etc) and other shapes. Accordingly, the number of the rows in which the antenna elements 11 are arranged can be equal to the number of the columns. Alternatively, the numbers of the rows and the columns in the antenna array can be different. Moreover, the number of the antenna elements 11 in neighboring rows can be either equal or different. Moreover, the arrangement of the antenna elements 11 in the array can be either regular or staggered, thereby forming a rectangular or triangular lattice.

It should still further be noted that the phase array antenna 10 may be used as a single radiator in conjunction with a transceiver device, or it may be combined together with additional antenna arrays to form a larger array antenna. And it should still further be noted that although the front side 18 of the array antenna shown in FIGS. 1A-1C has a planar shape, when desired, the array antenna may alternatively have a curved or undulated face.

A height $L_g$ of the gap in the common cavity 14 between the common superstrate layer 16 and a top of the plurality of antenna elements 11 depends on the desired deflection angles θ of the radiation beam. The deflection is calculated from an axis (not shown) perpendicular to the antenna aperture.

According to an embodiment, the height $L_g$ of the gap can be obtained by $$L_g \approx \begin{cases} \lambda_g\left(x+\frac{n}{2}\right), & \text{where } 0.6 \le x \le 0.65 \quad \text{for } 0^\circ \le \theta \le 15^\circ \\ \lambda_g(0.01\theta + 0.327 + 0.6n), & \text{for } 15^\circ < \theta \le 45^\circ \\ y\lambda_g, & \text{where } 0.45 \le y \le 0.5 \quad \text{for } 45^\circ < \theta \le 70^\circ \end{cases}$$

where $\lambda_g=\lambda_0/\sqrt{\in_g}$, and $\lambda_0$ is the wavelength corresponding to the central operation frequency of the phased array antenna, $\in_g$ is the dielectric permittivity of the dielectric material filling the gap in the common cavity 14, θ is the required deflection angle (in degrees), and n=0, 1, 2, . . . It should be noted that the case when n=0 is preferred.

According to an embodiment, a thickness of the common dielectric superstrate layer 16 is uniform and complies with a relationship $L_{SL}\approx\lambda_{SL}(0.2+n/2)$, where $\lambda_{SL}=\lambda_0/\sqrt{\in_{SL}}$, and $\lambda_0$ is the wavelength corresponding to the central operation frequency of the phased array antenna, $\in_{SL}$ is the dielectric permittivity of the common dielectric superstrate layer 16, and n=0, 1, 2, . . . It should be noted that the case when n=0 is preferred.

According to another embodiment, a thickness of the common dielectric superstrate layer 16 near walls of the common conductive shell 13 is different than the thickness of the common dielectric superstrate layer 16 at its center. Side surfaces of the common dielectric superstrate layer 16 can, for example, be biplanar surfaces, biconcave surfaces, plano-concave surfaces, and convex-concave surfaces.

According to an embodiment, the common superstrate layer 16 is made from a heat insulating material. According to an embodiment, an outer surface of the common superstrate layer 16 can be covered with a heat insulating material (not shown).

It was found that the configuration and parameters of the antenna element 11 and the phased array antenna structure 10 significantly affect their performance. Several examples of such dependencies will be illustrated herein below.

Figure 13:
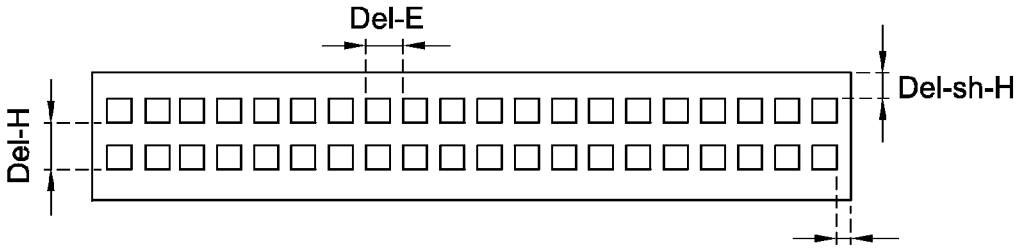
FIG. 13 shows an example of the phase array antenna used for computer simulations.

A computer simulation analysis was carried out in order to determine the effect of the presence of the common dielectric superstrate layer 16 together with the common conductive shell 13 on various characteristics of the phase array antenna shown in FIG. 1A. The simulations were carried out for an example of the phase array antenna shown in FIG. 13. According to this example, the array antenna includes 40 antenna elements 11 having a rectangular shape with the side of the common aperture 15 equal to $9.7\lambda_0$ and $2.1\lambda_0$. The antenna elements 11 are arranged in two rows in H-plane and with 20 antenna elements in each row arranged in E plane. The distance $D_{el-H}$ between the antenna elements in H plane was set to $\lambda_0/2$, whereas the distance $D_{el-E}$ between the antenna elements in E plane was set to $0.47\lambda_0$. The distance $D_{el-sh-H}$ between the edges of the antenna elements arranged in the two rows to the common conductive shell 13 in H plane was set to $0.65\lambda_0$, whereas the distance $D_{el-sh-E}$ between the edges of the edging elements (first and last) in the row to the common conductive shell 13 in E plane was set to $0.23\lambda_0$. The dielectric permittivity $\in_g$ of the dielectric material filling the gap in the common cavity (14 in FIG. 1A) was set to 1. The dielectric permittivity $\in_{SL}$ of the common dielectric superstrate layer (16 in FIG. 1A) was set to 4. The height $L_g$ of the gap in the common cavity (14 in FIG. 1A) between the common superstrate layer (16 in FIG. 1A) and a top of the plurality of antenna elements (11 in FIG. 1A) was varied between $0.13\lambda_0$ and $0.93\lambda_0$. The thickness $L_{SL}$ of the common dielectric superstrate layer 16 was set to $0.2\lambda_{SL}$ where $\lambda_{SL}=\lambda_0/\sqrt{\in_{SL}}$.

Figure 9:
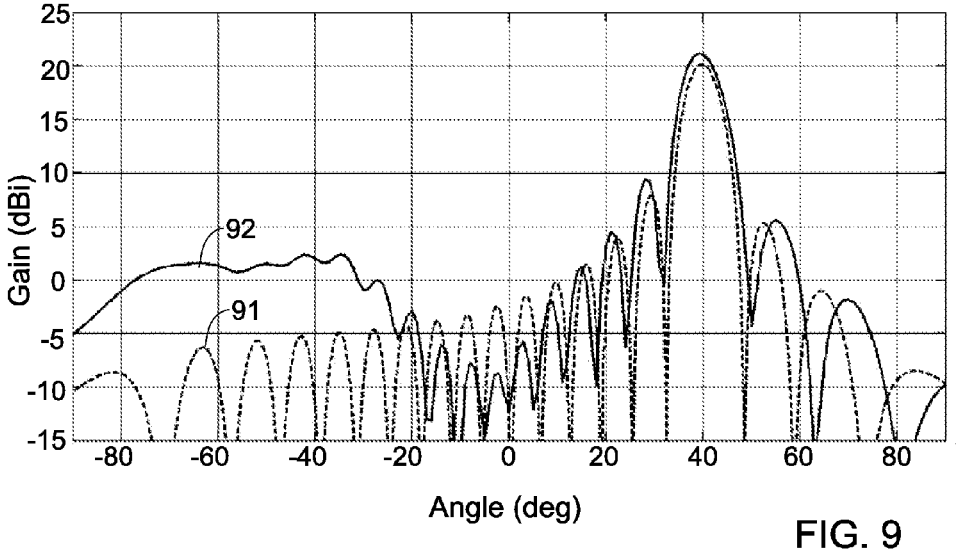
FIG. 9 shows the effect of the presence of the common dielectric superstrate layer together with the common conductive shell shown in FIG. 1A on the array pattern variation in E-plane for the scanning angle of 40 degrees when a height of the gap in the common cavity between the common superstrate layer and a top of the plurality of antenna elements is set to on optimal value for the scanning angle of 40 degrees.

FIG. 9 shows the effect of the presence of the common dielectric superstrate layer 16 together with the common conductive shell 13 shown in FIG. 1A on the array pattern variation in E plane for the scanning angle of 40 degrees. The height $L_g$ of the gap in the common cavity 14 between the common superstrate layer 16 and a top of the plurality of antenna elements is set to on optimal value of $0.73\lambda_0$ for the scanning angle of 40 degrees.

It was found that the antenna array has an optimal gain for the scanning angle of 40 degrees when the height $L_g$ of the gap in the common cavity 14 between the common superstrate layer 16 and a top of the plurality of antenna elements is set to $0.73\lambda_0$. A dotted line 91 corresponds to a radiation pattern of the phase antenna array without the superstrate layer 16 and without the common conductive shell 13. A continuous line 92 corresponds to a radiation pattern of the phase antenna array having the superstrate layer 16 and the common conductive shell 13. As can be seen, the presence of the superstrate layer and common conductive shell causes peak gain improvement by 1 dB. Moreover, in the presence of the superstrate layer and common conductive shell, the width of the beam is wider and the degradation in side lobe level is observed at angles in the range of −20 degrees to −90 degrees.

Figure 10A:
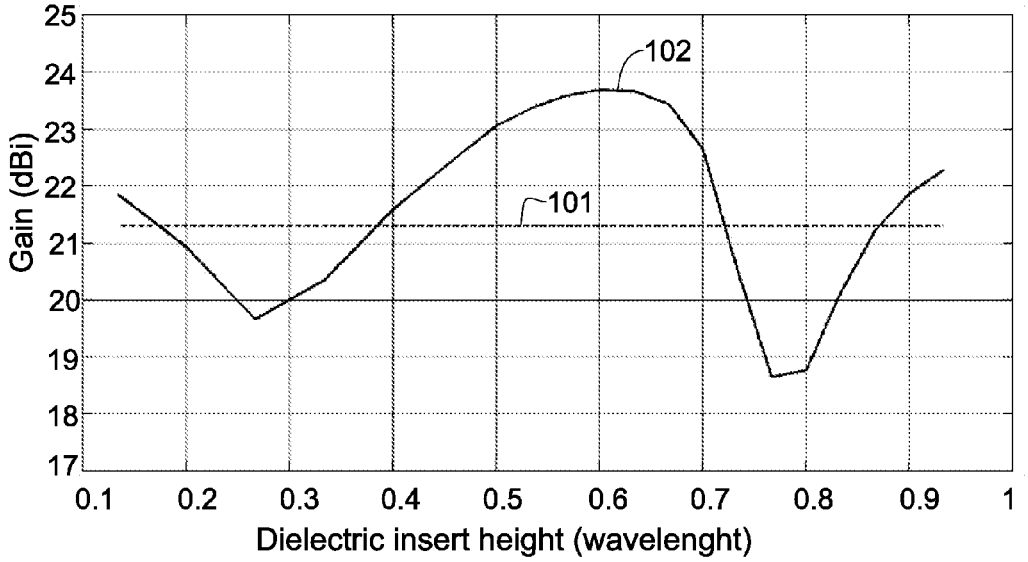
FIGS. 10A-10C show the effect of the presence of the common dielectric superstrate layer together with the common conductive shell shown in FIG. 1A on the array peak gain as a function of a height of the gap in the common cavity between the common superstrate layer and a top of the plurality of antenna elements at various deflection angles.
Figure 10B:
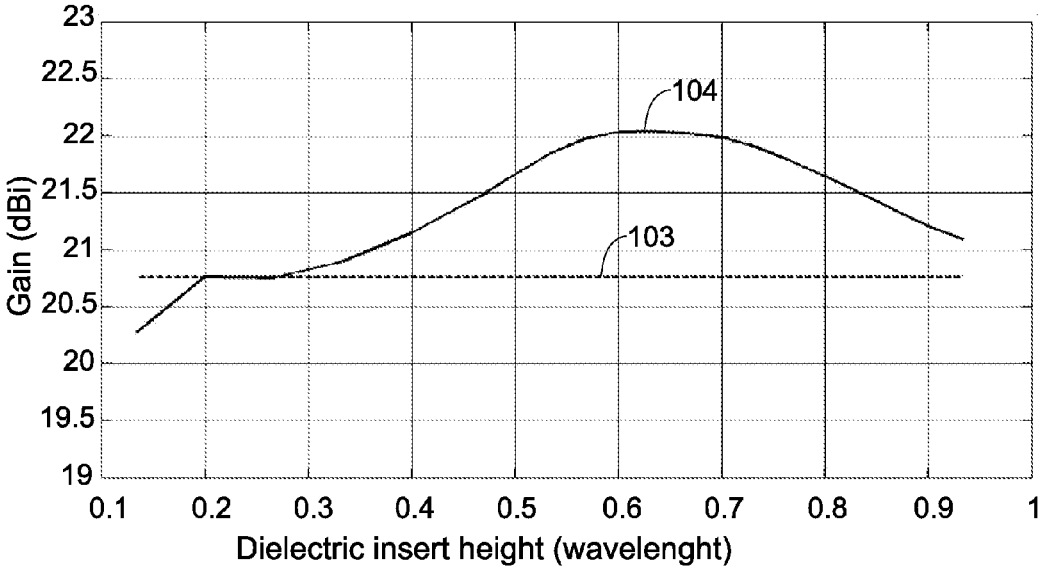
Figure 10C:
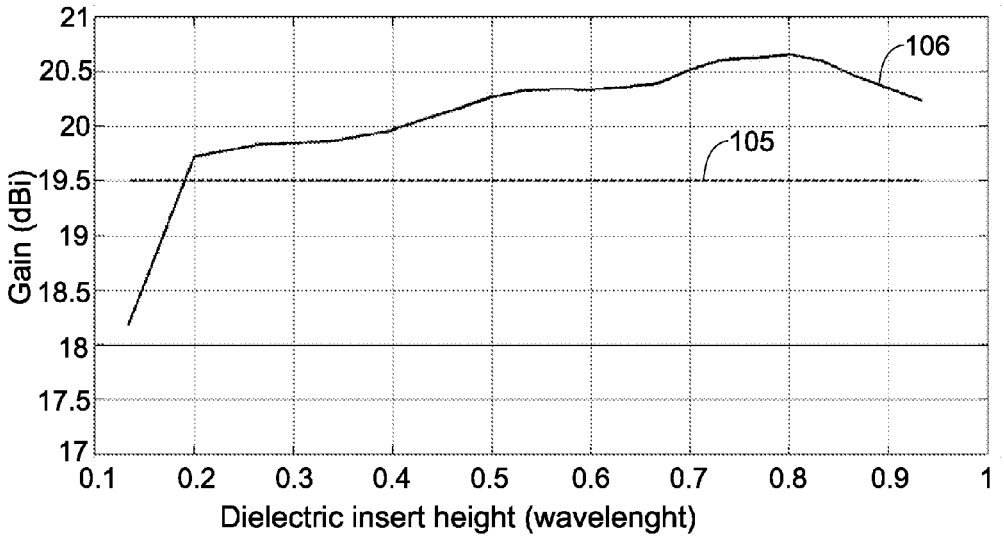

FIGS. 10A-10C show the effect of the presence of the common dielectric superstrate layer 16 together with the common conductive shell 13 shown in FIG. 1A on the array pattern for variation of a peak gain as a function of the height $L_g$ of the gap in the common cavity (14 in FIG. 1A) between the common superstrate layer (16 in FIG. 1A) and a top of the plurality of antenna elements (11 in FIG. 1A) at various deflection angles.

Referring to FIG. 10A, the dependence of the peak gain versus the height $L_g$ is shown when the deflection angle equals 0 degrees, i.e. no deflection. A dotted line 101 corresponds to a peak gain variation of the phase antenna array without the superstrate layer 16 and without the common conductive shell 13, whereas a continuous line 102 corresponds to a peak gain variation of the phase antenna array having the superstrate layer 16 and the common conductive shell 13. As can be seen, the presence of the superstrate layer and common conductive shell causes peak gain improvement when the height $L_g$ of the gap is in the range of $0.38\lambda_0$ to $0.72\lambda_0$. The optimal height $L_g$ of the gap for this case is equal to $0.6\lambda_0$, and the improvement of the peak gain for this case is 2.7 dBi that is equal to the increase in the system range by 36%.

Referring to FIG. 10B, the dependence of the peak gain versus the height $L_g$ is shown when the deflection angle equals 30 degrees. A dotted line 103 corresponds to a peak gain variation of the phase antenna array without the superstrate layer 16 and without the common conductive shell 13, whereas a continuous line 104 corresponds to a peak gain variation of the phase antenna array having the superstrate layer 16 and the common conductive shell 13.

As can be seen, the presence of the superstrate layer and common conductive shell causes peak gain improvement when the height $L_g$ of the gap is in the range of $0.28\lambda_0$ to $0.92\lambda_0$. The optimal height $L_g$ of the gap for this case is equal to $0.63\lambda_0$, and the improvement of the peak gain for this case is 1.2 dBi that is equal to the increase in the system range by 15%.

Referring to FIG. 10C, the dependence of the peak gain versus the height $L_g$ is shown when the deflection angle equals 45 degrees. A dotted line 105 corresponds to a peak gain variation of the phase antenna array without the superstrate layer 16 and without the common conductive shell 13, whereas a continuous line 106 corresponds to a peak gain variation of the phase antenna array having the superstrate layer 16 and the common conductive shell 13.

As can be seen, the presence of the superstrate layer and common conductive shell causes peak gain improvement when the height $L_g$ of the gap is in the range between $0.19\lambda_0$ and $0.93\lambda_0$. The optimal height $L_g$ of the gap for this case is equal to $0.8\lambda_0$, and the improvement of the peak gain for this case is 1.2 dBi that is equal to the increase in the system range by 15%.

Figure 11:
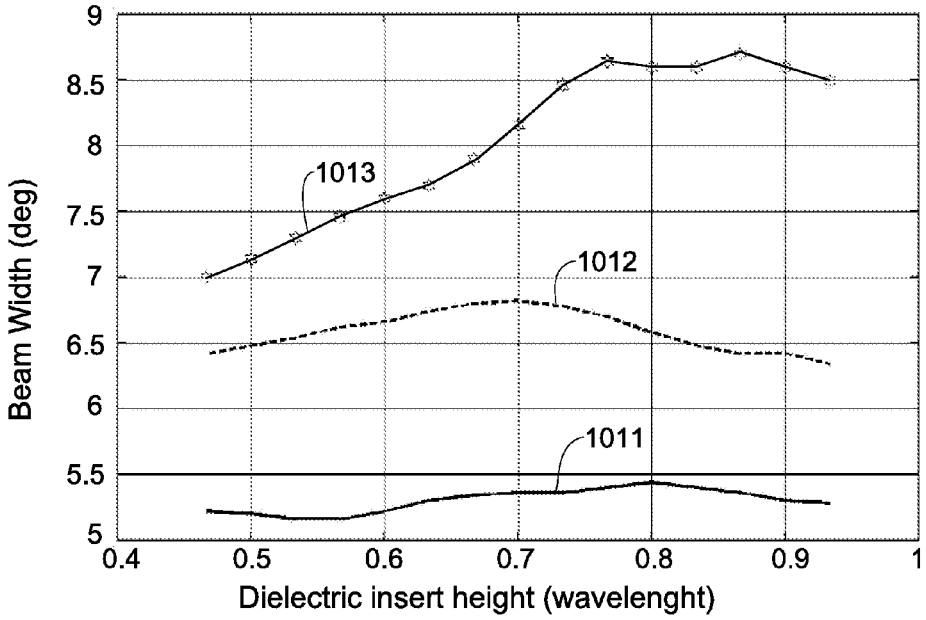
FIG. 11 shows the dependence of the beam width in E plane versus the height of the gap in the common cavity between the common superstrate layer and a top of the plurality of antenna elements at various deflection angles.

FIG. 11 shows the dependence of the beam width versus the height $L_g$ when the deflection angle equals 0 degrees, i.e. no deflection (curve 1011), 30 degrees (curve 1012) and 45 degrees (curve 1013).

As can be seen from the behavior of curve 1011, the changes of the height $L_g$ have insignificant effect onto the beam width for the case when the deflection angle is 0 degrees. In particular, when the height $L_g$ of the gap increases from $0.46\lambda_0$ to $0.93\lambda_0$ the beam width varies in the range of 5.2-5.4 degrees (i.e., by 4%). It should be noted that for the case of the phase antenna array without the superstrate layer 16 and without the common conductive shell 13 the beam width equals 5.3 degrees.

As can be seen from the behavior of curve 1012, the changes of the height $L_g$ of the gap have greater effect onto the beam width when the deflection angle is 30 degrees. In particular, when the height $L_g$ of the gap increases from $0.46\lambda_0$ to $0.93\lambda_0$ the beam width varies in the range of 6.4-6.8 degrees (i.e., by 6%). It should be noted that for the case of the phase antenna array without the superstrate layer 16 and without the common conductive shell 13 the beam width equals 6.2 degrees. As can be seen, the presence of superstrate layer 16 and the common conductive shell 13 results in a wider beam. It should be noted that the peak gain is also increased when the height $L_g$ of the gap increases from $0.46\lambda_0$ to $0.93\lambda_0$, that enhances the performance of the array antenna by covering a greater area.

As can be seen from the behavior of curve 1013, the changes of the height $L_g$ of the gap have the most significant effect onto the beam width when the deflection angle is 45 degrees. In particular, when the height $L_g$ of the gap increases from $0.46\lambda_0$ to $0.93\lambda_0$ the beam width varies in the range of 7-8.7 degrees (i.e., by 24%). It should be noted that for the case of the phase antenna array without the superstrate layer 16 and without the common conductive shell 13 the beam width equals 7.6 degrees. As can be seen, for the case when the deflection angle is 45 degrees, the optimal height $L_g$ of the gap is $0.86\lambda_0$. it should be noted that the increase of the beam width occurs concurrently with the increase of the peak gain that enhances the performance of the array antenna by covering a greater area.

Figure 12A:
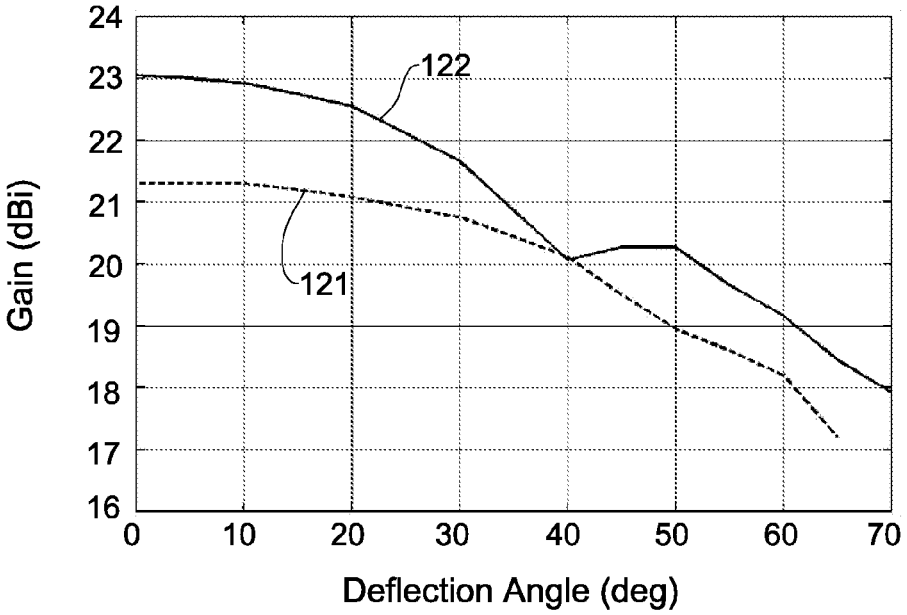
FIGS. 12A-12C show the effect of the presence of the common dielectric superstrate layer together with the common conductive shell shown in FIG. 1A on the array pattern for variation of a peak gain as a function of the deflection angle at various heights of the gap in the common cavity between the common superstrate layer and a top of the plurality of antenna elements.
Figure 12B:
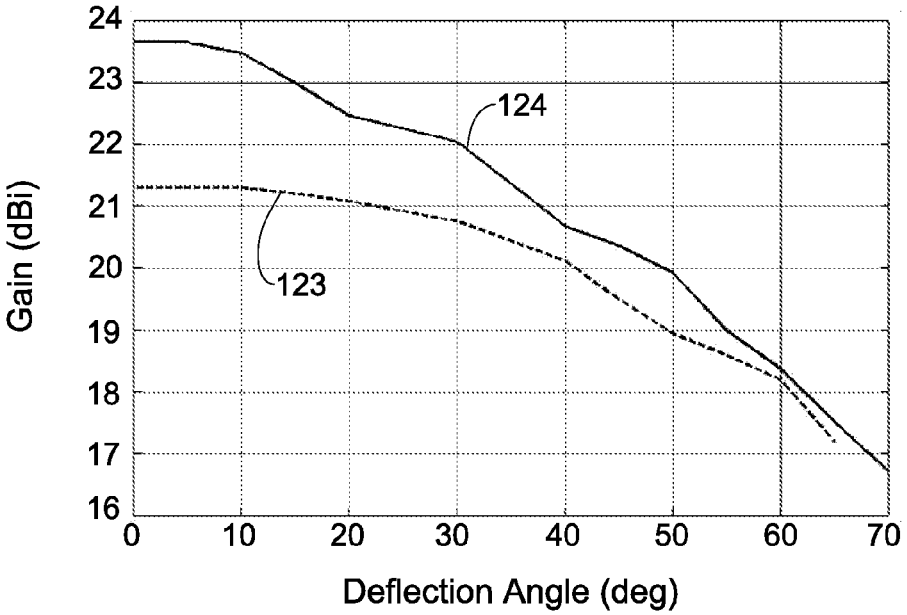
Figure 12C:
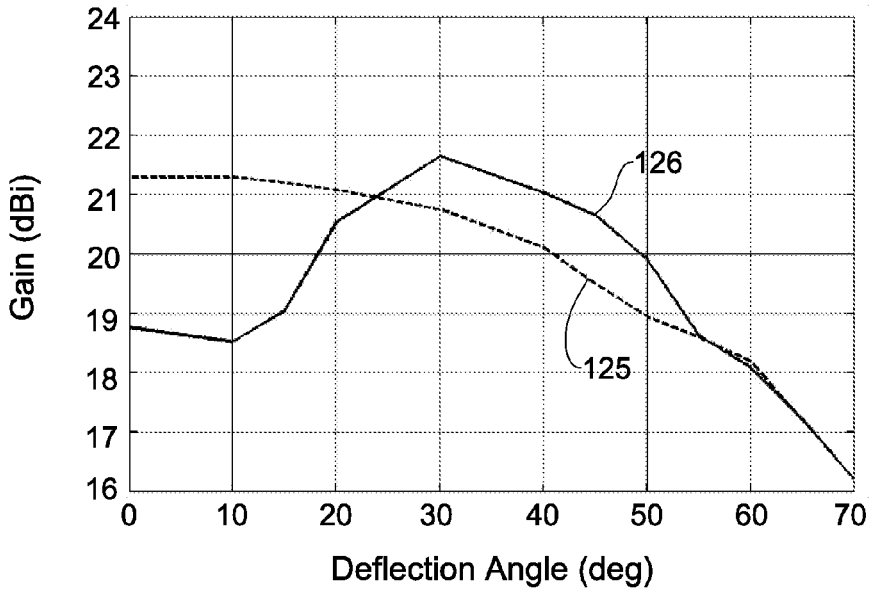

FIGS. 12A-12C show the effect of the presence of the common dielectric superstrate layer 16 together with the common conductive shell 13 shown in FIG. 1A on the array pattern for variation of a peak gain in E plane as a function of the deflection angle at various heights $L_g$ of the gap in the common cavity (14 in FIG. 1A) between the common superstrate layer (16 in FIG. 1A) and a top of the plurality of antenna elements (11 in FIG. 1A).

Referring to FIG. 12A, the dependence of the peak gain versus the deflection angle is shown when the height $L_g$ is equal to $\lambda_0/2$. A dotted line 121 corresponds to a peak gain variation of the phase antenna array without the superstrate layer 16 and without the common conductive shell 13, whereas a continuous line 122 corresponds to a peak gain variation of the phase antenna array having the superstrate layer 16 and the common conductive shell 13. As can be seen, the presence of the superstrate layer and common conductive shell causes improvement of the peak gain for the deflection angles in the range of 0 degrees to 38 degrees and 40 degrees to 70 degrees by about 1 dB to 1.7 dB that corresponds to the increase in the system range by about 12% to 22%. Accordingly, in order to obtain the maximum peak gain performance for this antenna for the deflection angles in the range of 45°-70° one has to choose the height $L_g$ the gap to be equal to $\lambda_0/2$.

Referring to FIG. 12B, the dependence of the peak gain versus the deflection angle is shown when the height $L_g$ is equal to $0.63\lambda_0$. A dotted line 123 corresponds to a peak gain variation of the phase antenna array without the superstrate layer 16 and without the common conductive shell 13, whereas a continuous line 124 corresponds to a peak gain variation of the phase antenna array having the superstrate layer 16 and the common conductive shell 13. As can be seen, the presence of the superstrate layer and common conductive shell causes improvement of the peak gain for the deflection angles in the range of 0 degrees to 70 degrees. The maximal improvement of the peak gain by up to about 2.5 dB is observed at relatively small deflection angles in the range of 0 degrees to 5 degrees that corresponds to the increase in the system range by about 30%. In the range of the deflection angles of 55 degrees-65 degrees the peak gain improvement is about 0.25 dBi that corresponds to the increase in the system range by about 3%. Accordingly, in order to obtain the maximum peak gain performance for this antenna for the deflection angle of 30° one has to choose the height $L_g$ the gap to be equal to $0.63\lambda_0$.

Referring to FIG. 12C, the dependence of the peak gain versus the deflection angle is shown when the height $L_g$ is equal to $0.8\lambda_0$. A dotted line 125 corresponds to a peak gain variation of the phase antenna array without the superstrate layer 16 and without the common conductive shell 13, whereas a continuous line 126 corresponds to a peak gain variation of the phase antenna array having the superstrate layer 16 and the common conductive shell 13. As can be seen, the presence of the superstrate layer and common conductive shell causes a decrease in the peak gain for the deflection angles in the range of 0 degrees to 24 degrees, increases the peak gain for the deflection angles in the range of 25 degrees to 55 degrees, and does not affect the peak gain for the deflection angles in the range of 55 degrees to 70 degrees. The maximal improvement of the peak gain by up to about 1.2 dB is observed at the deflection angle of about 45 degrees that corresponds to the increase in the system range by about 15%. Accordingly, in order to obtain the maximum peak gain performance for this antenna for the deflection angle of 45° one has to choose the height $L_g$ the gap to be equal to $0.8\lambda_0$. For the deflection angles less than about 25° the antenna with such a configuration will not be operable.

The antenna elements 11 of phase array antenna structure 20 can be implemented in various ways.

Figure 2A:
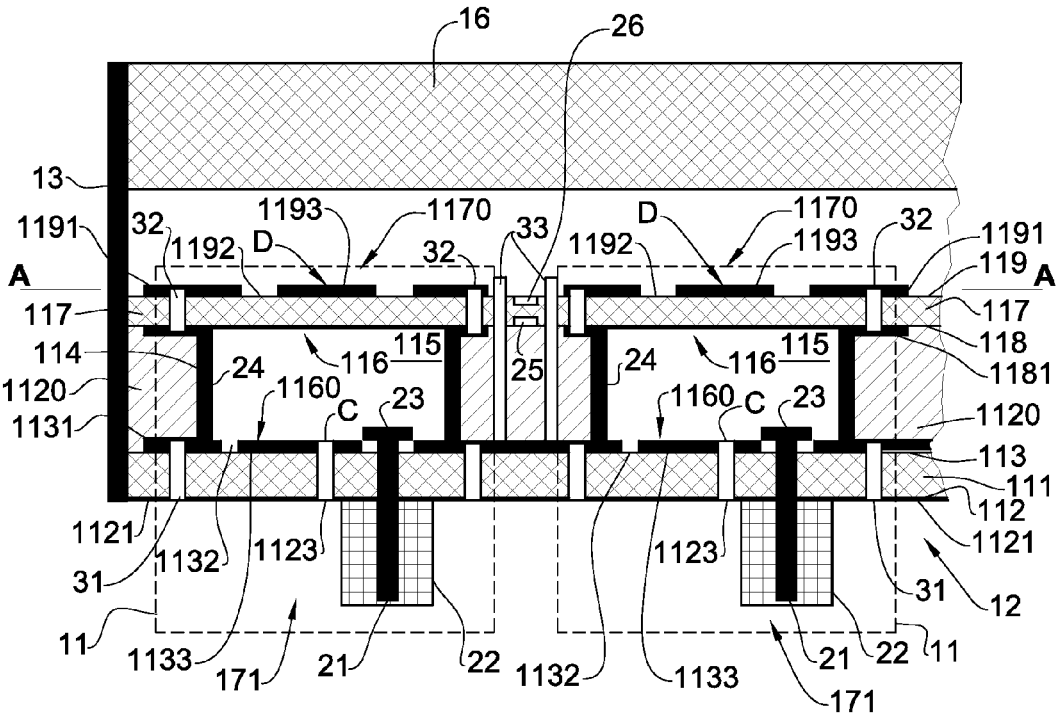
FIG. 2A is a schematic side cross-sectional fragmentary view of the phased array antenna of FIG. 1A illustrating a side cross-sectional view of antenna elements, according to one embodiment of the present invention.

Referring to FIG. 2A, a schematic side cross-sectional fragmentary view of the phased array antenna of FIG. 1A is illustrated with an enlarged side cross-sectional view of the antenna elements 11, according to one embodiment of the present invention.

According to this embodiment, each antenna element 11 has a vertically stacked structure. The term "vertically stacked" is used herein for the purpose of description of a relationship between the components of the antenna element 11, rather than for description of orientation of the antenna structure in space. It should be noted that only two antenna elements closest to the common conductive shell 13 are shown in the selected fragment in FIG. 2A.

Starting the description of the antenna element 11 from the bottom, the vertically stacked structure of antenna element 11 includes a bottom dielectric substrate 111 having a bottom substrate underside 112 and a bottom substrate upper side 113.

According to one embodiment, the dielectric substrate 111 is common for all the antenna elements 11. According to another embodiment, at least a part of the antenna in elements 11 has individual (not shown) dielectric substrates 111 separated from each other.

The dielectric substrate 111 is provided with two-side thin metallic coatings (dads). As will be described herein below, appropriate etching of these coatings defines the antenna element configuration and properties.

According to the embodiment shown in FIG. 2A, the common conductive ground plane (12 in FIGS. 1A-1C) of the phased array antenna 10 is formed from two metallic bottom coatings (a lower bottom coating 1121 and an upper bottom coating 1131) adhesively bound to the bottom substrate underside 112 and to the bottom substrate upper side 113, correspondingly. It should be noted that the terms "bottom" and "top" are used herein for the purpose of description of a relationship between the components of the phased array antenna, rather than for description of orientation of the antenna structure in space. The lower bottom coating 1121 and the upper bottom coating 1131 are grounded, thereby forming the ground plane (12 in FIGS. 1A-1C).

There is a wide choice of materials suitable for the lower and upper bottom coatings 1121 and 1131. These coatings can generally be made of conductive material. Examples of conductive materials suitable for the bottom coatings 1121 and 1131 include, but are not limited to, copper, silver, gold and their alloys. The coatings 1121 and 1131 are selected to be rather thin, such that their thickness is much less than the free-space operating wavelength.

The antenna element 11 also includes an antenna element conductive shell 114 extending away from the bottom substrate upper side 113 and connected to the upper bottom coating 1131 arranged on the bottom substrate upper side 113. The antenna element conductive shell 114 has a lumen that defines an antenna element cavity 115 with an antenna element aperture 116. As can be understood the antenna element cavity 115 is formed by the upper bottom coating 1131 and the antenna element conductive shell 114. A transverse cross-section of the antenna element conductive shell 114 (that defines the shape of the aperture 116), can generally have any desired shape, including, but not limited to, a circular shape, oval shape, D-shape polygonal shape (e.g., triangular, square, rectangular, quadrilateral, pentagon, hexagonal, etc) and other shapes. When the antenna element conductive shell 114 has a tubular shape, a diameter of antenna element cavity 115 can, for example, be in the range of $0.1\lambda_0$ to $0.6\lambda_0$, where $\lambda_0$ is the wavelength corresponding to the central operation frequency. Such a relatively small contour of the cavity 115 is essential for providing great deflection angles for radiation.

The conductive shell 114 can, for example, be formed from aluminum to provide a lightweight structure, although other materials, e.g., copper, zinc plated steel, can also be employed. According to some embodiments, antenna element cavity 115 can be filled with a dielectric material having a dielectric permittivity greater than the dielectric permittivity of air.

The antenna element 11 also includes a feeding radiator 1160 printed on the bottom substrate upper side 113 and backed by the cavity 115. To form the feeding radiator 1160, the upper coating 1131 has a bottom slot 1132 defining a bottom feeding patch 1133 encompassed by the bottom slot 1132.

According to one embodiment, the bottom slot 1132 is a circular slot (in the shape of a circular ring) defining a circular bottom patch printed on the bottom substrate upper side 113. However, generally, a shape of the bottom slot 1132 and the bottom patch 1133 may have any desired shape, including, but not limited to, an oval shape, a D-shape polygonal shape (e.g., triangular, square, rectangular, quadrilateral, pentagon, hexagonal, etc) and other shapes.

The bottom patch 1133 can, for example, be etched on the surface of the dielectric substrate 113 by using a conventional photolithography technique; however other techniques can also be used. The bottom slot 1132 separates the bottom patch 1133 from the common conductive ground plane 12. When coupled to a suitable feed, the bottom patch 1133 can be used for radiating electromagnetic energy. Preferably, but not mandatory, the circular bottom feeding patch 1133 is centered at the bottom of the antenna element cavity 115. When the bottom patch 1133 has a circular shape, a diameter of the circular patch 1133 can, for example, be in the range of $0.05\lambda_0$ to $0.35\lambda_0$, where $\lambda_0$ is the wavelength corresponding to the central operation frequency. This relatively small radiation element contour is essential for providing great deflection angles for radiation.

It should be noted that the bottom slot 1132 can also be used for radiating electromagnetic energy, mutatis mutandis. A width of the bottom radiating slot 1132 can, for example, be in the range of $0.01\lambda_0$ to $0.15\lambda_0$.

The antenna element 11 further includes a parasitic radiator 1170 backed by the cavity 115 and parasitically coupled to the feeding radiator 1160. To form parasitic radiator 1170, the antenna element 11 includes a top dielectric substrate 117 common for all the antenna elements 11 in the phased array antenna 10. The top dielectric substrate 117 has a top substrate underside 118 and a top substrate upper side 119. The top dielectric substrate 117 is disposed over the antenna element cavity 115, and has two conductive top coatings (a lower top coating 1181 and an upper top coating 1191) adhesively bound to the top substrate underside 118 and to the bottom substrate upper side 119, correspondingly. The conductive coatings 1181 and 1191 can, for example, be formed from copper, gold, silver, etc. When desired their alloys can also be used.

The antenna element conductive shell 114 is connected to the lower top coating 1181. According to the embodiment shown in FIG. 2, the lower top coating 1181 has an area free from metal which faces the antenna element aperture 116 and repeats a contour of its perimeter. For example, when the antenna element aperture 116 has a circular shape, this free of metal area has also the same circular shape.

It should be noted that a cross-sectional size of the antenna element aperture 116 (i.e., the area free from the metal in the lower top coating 1181) may be equal to or less than the cross-sectional size of the antenna element conductive shell 114.

Figure 2B:
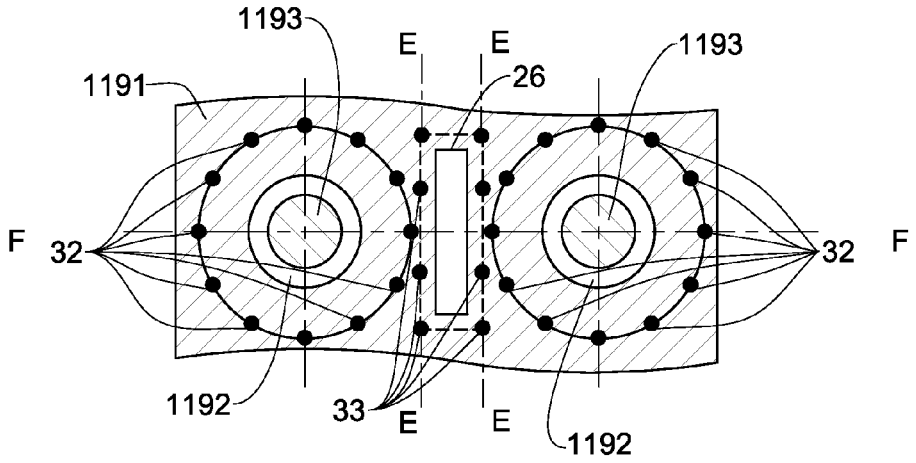
FIG. 2B illustrates a schematic transverse cross-sectional fragmentary view through A-A plane of FIG. 2A of an exemplar phased array antenna of the present invention.

FIG. 2B illustrates a schematic transverse cross-sectional fragmentary view through A-A plane of the phased array antenna shown in FIG. 2A. This A-A plane corresponds to the plane of the top substrate underside 118.

Referring to FIGS. 2A and 2B together, the upper top coating 1191 has a top slot 1192 defining a top radiating patch 1193 printed on the top substrate upper side 119 in the upper top coating 1191. Alternatively, when desired, a top slot and a top radiating patch (not shown) can be printed within the antenna element cavity 115 on the top substrate underside 118 of the top dielectric substrate 117 in the lower top coating 1181.

Generally, the top slot 1192 and the top patch 1193 can have any desired shape. However, when the bottom slot 1132 has a circular ring shape, preferably, but not mandatory, then the top slot 1192 would also have a circular ring shape. Likewise, when the bottom patch 1133 has a circular shape, preferably, but not mandatory, then the top patch 1193 would also have a circular shape.

The top radiating patch 1193 is disposed over and spaced apart from the feeding radiator 1160 at predetermined distance h, and is parasitically coupled either to the bottom patch 1133 or to the circular bottom slot 1132. When the top patch 1193 has a circular shape, a diameter of the patch 1193 can, for example, be in the range of $0.05\lambda_0$ to $0.35\lambda_0$, whereas a width of the circular bottom slot 1192 can, for example, be in the range of $0.01\lambda_0$ to $0.15\lambda_0$, where $\lambda_0$ is the wavelength corresponding to the central operation frequency. A ratio between a maximal horizontal cross-sectional dimension of the antenna element cavity 115 and the maximal dimension of the top radiating patch 1193 can, for example, be in the range of 0.5 to 0.95. Turning back to FIG. 2A, the antenna elements 11 are fed by the feed arrangement 171. As shown in FIG. 2A, the feed arrangement 171 includes a plurality of radio frequency (RF) coaxial lines (vertical probes), each coaxial line having an inner conductor 21 and an outer conductor 22. The inner conductor 21 is extended through an opening in the bottom dielectric substrate 111 and in the conductive ground plane 12, and is electrically (e.g., galvanically) connected to the bottom feeding patch 1133 at a feed point 23 for providing radio frequency energy thereto. When required, the outer conductor 22 is connected to the ground plane 12.

The feed point 23 is located within the bottom patch 1133; however other implementations are also contemplated. Preferably, the feed point 23 is arranged at a certain distance from the center C of the circular bottom patch 1133, required to provide optimal feed impedance matching and mitigation of cross-pole components of the linearly polarized beam excitation. For example, the distance between the center C of the circular bottom patch 1133 and the feed point 23 can be in the range of $0.02\lambda_0$ to $0.15\lambda_0$, where $\lambda_0$ is the wavelength corresponding to the central operation frequency.

It should be appreciated that the antenna element described above has the ability to operate in any polarization chosen. This implies that the antenna element can provide vertical, horizontal or circular polarized radiation. When desired, the radiation can be polarized to 45 degrees or any other polarization desired. The reason is that the polarization is determined by the position of the feed point 23 with respect to the printed circular bottom patch 1133. When the patch 1133 is symmetric the feed point 23 can be located in any position desired.

If circular polarization is desired, two feed points (not shown) on the bottom patch 1133 are fed by two orthogonally phased (90° shifted) signals.

Another implementation for providing circular/elliptical polarization can be a single point external feed with inherent splitter and phase shift that can be implemented on the surface of the patch 1133 for double-point patch excitation.

Still another implementation for providing circular/elliptical polarization with the antenna element described above can be a single point feed radiating element configured for providing circular/elliptical polarization. In particular, circular/elliptical polarization can be archived by a suitable configuration of the radiating patch. Examples of the radiating patch providing circular/elliptical include, but are not limited to, a triangular shaped patch, a rectangular shaped, a mainly circular patch which has a slightly perturbed circular shape, etc.

According to an embodiment of the present invention, the antenna element 11 includes an intermediate layer 1120 sandwiched between the bottom dielectric substrate 111 and the top dielectric substrate 117. The intermediate layer 1120 is a structural spacer providing a desired vertical separation and support to the bottom dielectric substrate 111 and the top dielectric substrate 117.

According to one embodiment, the intermediate layer 1120 is formed from a solid dielectric material having a predetermined dielectric permittivity. According to an embodiment, the intermediate layer 1120 may be coated, with a two-side metallic clad or with a one-side metallic clad on an upper or bottom sides. According to another embodiment, the intermediate layer 1120 may be uncoated, i.e., totally stripped of its two-side metallic clad. The layer 1120 is sieved by a through hole, which can be metallized on an inner surface 24 by a metal clad (e.g., copper, gold, etc.), thereby to form the antenna element cavity 115 which backs and encompasses the stacked radiating pair formed from the feeding radiator 1160 and the parasitic radiator 1170.

The dielectric constant value of the bottom dielectric substrate 111, the intermediate layer 1120 and the top dielectric substrate 117 can differ in a broad range of values. For example, the dielectric constants of the bottom dielectric substrate 111 and the top dielectric substrate 117 can be between 1 and 10, whereas the dielectric constant of the intermediate layer 1120 can be between 1 and 100. The values of the dielectric constant are determined by the desired operation frequency, bandwidth, matching optimization, as well as by the dimensions of the antenna element. The relatively higher dielectric constant value for the intermediate layer allows for intra-element coupling mitigation for the antenna array. A thickness of the bottom dielectric substrate 111, the intermediate layer 1120 and the top dielectric substrate 117 is determined by the operating central frequency, bandwidth and structural constraints. For example, the thickness of the bottom dielectric substrate 111 can be in the range of $0.01\lambda_0$ to $0.2\lambda_0$, the thickness of the top dielectric substrate 117 can be in the range of $0.01\lambda_0$ to $0.15\lambda_0$, and the thickness of the intermediate layer 1120 can be in the range of $0.05\lambda_0$ to $0.3\lambda_0$, where $\lambda_0$ is the wavelength corresponding to the central operation frequency.

According to some embodiments, the antenna of the present application includes one or more vias that may connect conductive coatings from one surface of the dielectric substrates to other surface(s).

For example, the bottom feeding patch 1133 can be galvanically and electromagnetically grounded by an electrically conductive via 1123 at a central loci point C. The central loci point C can also be connected to the grounded lower bottom coating 1121. This provision can enhance the polarization quality and mitigates the cross-pole components of the excitation.

Figure 7:
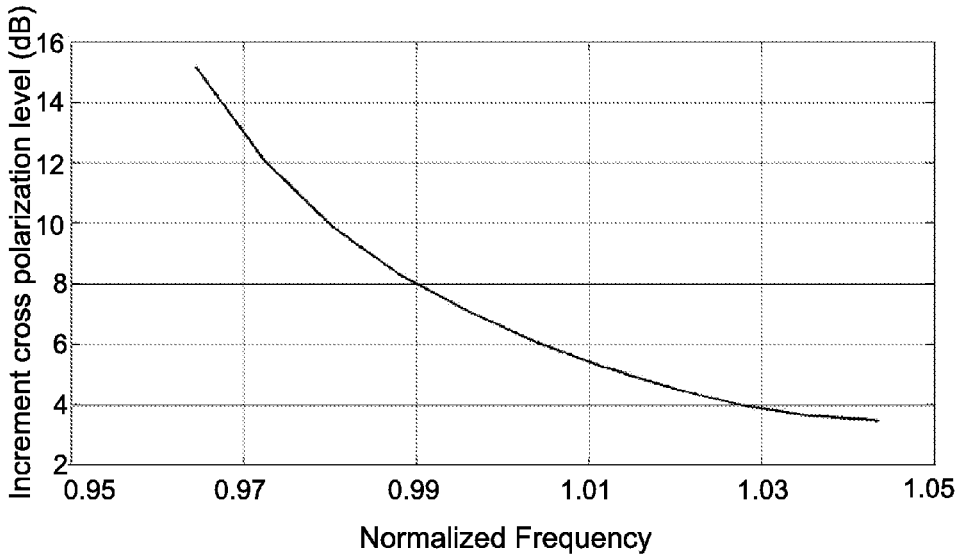
FIG. 7 shows exemplary graphs depicting the frequency dependence of the increment of the cross-polarization level on the antenna element performance for the antenna element shown in FIGS. 2A and 2B.

A computer simulation analysis was carried out in order to study the effect of the presence of the electrically conductive via 1123 on the resonant frequency of the antenna element. Referring to FIG. 7, exemplary graphs depicting the frequency dependence of the increment of the cross-polarization level on the antenna element performance is shown for the antenna element shown in FIGS. 2A and 2B. The increment is the difference between the cross-polarization levels in the cases of the absence and presence of the electrically conductive via 1123.

For example, in the range of the normalized frequency $F/F_0$ from 0.97 to 1.03 (±3% of the normalized frequency), the providing of the electrically conductive via 1123 results in the increase of the cross-polarization level between 3.5 dB and 13 dB.

Referring to FIGS. 2A and 2B together, the antenna of the present application further includes a plurality of bottom encompassing vias 31 connecting the conductive lower bottom coating 1121 (i.e., ground plane) mounted on the bottom substrate underside 112 to the upper bottom coating 1131 mounted on the bottom substrate upper side 113. Likewise, the antenna of the present application further includes a plurality of top encompassing vias 32 connecting the conductive lower top coating 1181 (i.e., ground plane) mounted on the top substrate underside 118 to the upper top coating 1191 mounted on the top substrate upper side 119.

The vias 31 encompass the feeding radiator 1160 and form an equivalent (virtual) coaxial-type ground cavity around it, thereby preventing energy leakage through the bottom dielectric substrate 111. Likewise, the vias 32 encompass the parasitic radiator 1170 and form an equivalent (virtual) coaxial-type ground cavity around it, thereby preventing energy leakage through the top dielectric substrate 117. Thus, enhanced isolation between the antenna array elements (having common bottom and top dielectric substrates) is achieved. The number of the vias 31 and 32 depends, inter alia, on the operation frequency, antenna configuration and manufacturing tolerance.

For example, in the case of the circular bottom feeding patch 1133 and the circular top radiating patch 1193, the number of the vias 31 and 32 that encircle these patches, can be in the range of 12 to 24. The encircling vias 31 are located at a predetermined distance from the central loci point C of the bottom feeding patch 1133. Likewise, the encircling vias 32 are located at a predetermined distance from the central loci point D of the top patch 1193.

The circle diameter for location of the vias 31 and 32 can, for example, be greater than the diameter of the patches 1133 and 1193 and the corresponding slot-rings outer diameter, but less than $0.5\lambda_0$ to provide relatively dense arrangement of the antenna element and thereby to avoid grating lobes generated in the pattern of the radiated energy from the array. It was found by the Applicant that this condition may provide efficient beam deflection of the antenna radiation by up to 70° and even greater from the boresight.

It should be noted that the location of the encircling vias 31 and 32 and their placement scheme can differ from the patterns shown in FIGS. 2A and 2B. In particular, the location diameter should be greater than the corresponding patch and slot-ring outer diameter, but is not necessarily always greater than the diameter of the antenna element cavity 115. Furthermore, a location diameter of the vias 31 may differ from the location diameter of the vias 32. A distance between a pair of neighboring encircling vias 31 and between a pair of neighboring encircling vias 32 can, for example, be in the range of $0.005\lambda_0$ to $0.2\lambda_0$.

When desired, either the vias 31 or the vias 32 can be extended to pass through the intermediate layer 1120 and through the top dielectric substrate 117 to connect the conductive lower bottom coating 1131 (i.e., the ground plane) mounted on the bottom substrate underside upper side 113 to the upper top coating 1191 mounted on the top substrate upper side 119. In this case, the location diameter of the circle for location of such vias can, for example, be greater than the diameter of the patches 1133, the diameter of the patches 1193 and the diameter of the antenna element conductive shell 114.

According to an embodiment of the present application, the phased array antenna 10 includes a plurality of separating vias 33 passing through the intermediate layer 1120 and the top dielectric substrate 117, and connecting the conductive upper bottom coating 1131 (i.e., ground plane) mounted on the bottom substrate upper side 113 to the upper top coating 1191 mounted on the top substrate upper side 119. The purpose of the separating vias 33 is to reduce inter-elements coupling between the antenna elements 11.

The separating vias 33 are arranged between the antenna elements 11 in two rows between each neighboring pair of the elements 11. The separating vias 33 are arranged along planes E-E which are perpendicular to a plane F-F passing through the central loci points C and D. A number of the separating vias 33 in each row can, for example, be in the range of 4 to 12 (only four vias 33 are shown in FIG. 2B). A distance between the first and last vias 33 along the plane E-E can, for example be in the range of $\lambda_0/2$. The separating vias 33 are located after the encircling vias 31 and 32 from the central loci points C and D. A distance between the central loci points C and D and the closest plane E-E is less than half of the distance between the central loci points of two close neighboring pair of the antenna elements 11. A distance between two neighboring planes E-E can, for example, be in the range of $0.01\lambda_0$ to $0.2\lambda_0$.

According to an embodiment of the present application, the phased array antenna 10 includes separating notches 25 and 26 arranged between the separating vias 33 and cut into the conductive lower top coating 1181 mounted on the top substrate underside 118 and into the upper top coating 1191 mounted on the top substrate upper side 119, correspondingly. The separating vias 33 form a virtual cavity over the separating notches 25 and 26. A length of the separating notches 25 and 26 can, for example, be in range of $0.1\lambda_0$ to $\lambda_0/2$, whereas a width of the separating notches 25 and 26 can, for example, be in the range of $0.01\lambda_0$ to $0.3\lambda_0$.

Figure 8:
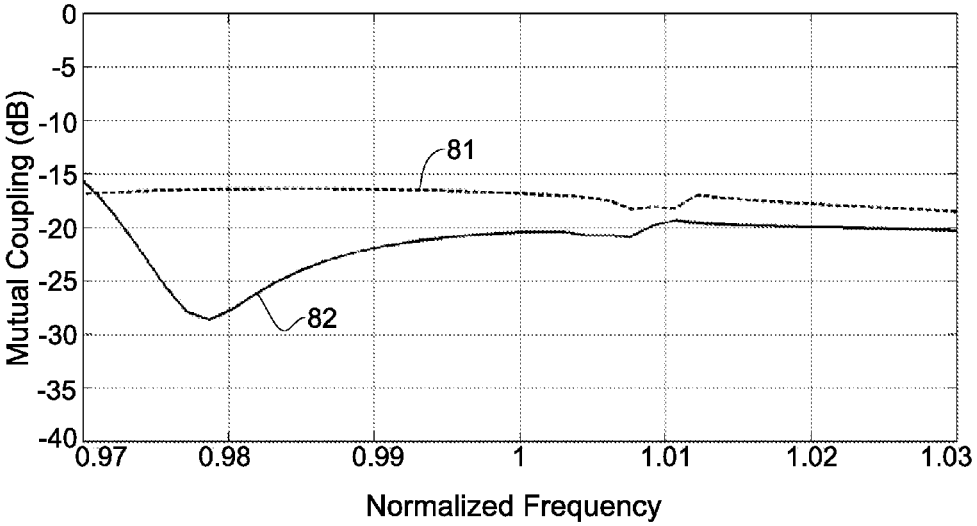
FIG. 8 shows exemplary graphs depicting the frequency dependence of the mutual coupling on the antenna element performance for the antenna element shown in FIGS. 2A and 2B in the cases of the absence and presence of the separating vias and the separating notches arranged between the separating vias of the neighboring antennas.

A computer simulation analysis was carried out in order to determine the effect of the presence of the separating notches 25 and 26 and the separating vias 33 on the resonant frequency of the antenna element. Referring to FIG. 8, exemplary graphs depicting the frequency dependence of the mutual coupling in E-plane (Polarization Axis) between two neighboring antenna elements is shown for the antenna element shown in FIGS. 2A and 2B, in the cases of the absence and presence of the separating notches 25, 26 and vias 33. Specifically, a curve 81 corresponds to the case of the antenna element without the separating notches 25, 26 and vias 33, whereas curve 82 corresponds to the case having the separating notches 25 and 26 and the separating vias 33. The simulation was performed for the configuration when the distance between the neighboring antenna elements in E-plane was set to $0.47\lambda_0$. The simulation was performed for the antenna elements without superstrate layer 16.

As can be seen, the mutual coupling in E-plane between two neighboring antenna elements decreases by 2 dB to 11 dB in the range of the normalized frequency $F/F_0$ between 0.97 and 1.03 in the case of the presence of the separating notches 25, 26 and vias 33. The effect is most significant at $F/F_0=0.978$.

Figure 6:
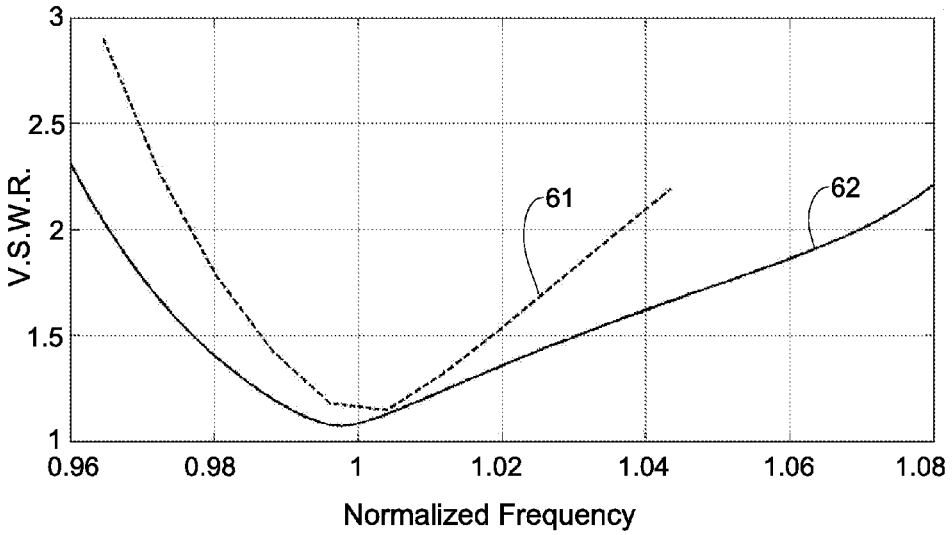
FIG. 6 shows exemplary graphs depicting the frequency dependence of the Voltage Standing Wave Ration (VSWR) on the antenna element performance for the antenna element shown in FIGS. 2A and 2B in the cases of the absence and presence of the common dielectric superstrate layer.

A computer simulation analysis was carried out in order to find the effect of the presence of the common dielectric superstrate layer 16 on the resonant frequency of the antenna element. Referring to FIG. 6, exemplary graphs depicting the frequency dependence of the Voltage Standing Wave Ratio (VSWR) on the antenna element performance is shown for the antenna element shown in FIGS. 2A and 2B, in the cases of the absence and presence of the common dielectric superstrate layer. Specifically, curve 61 corresponds to the case of the antenna element without the superstrate layer, whereas curve 62 corresponds to the case when a height $L_g$ of the gap in the common cavity 14 between the common superstrate layer 16 and the top of the plurality of antenna elements 11 equals $\lambda_0/2$, and a thickness $L_{SL}$ of the common dielectric superstrate layer 16 is uniform and equals $0.2\lambda_0$.

As can be seen, a bandwidth of the antenna element of the antenna element of the present application is relatively wide even without the superstrate layer. In particular, a VSWR is less than 1.5:1 in the range of 0.986 to 1.017 that correspond to 3.1% of the normalized frequency $F/F_0$, and less than 2.0:1 in the range of 0.978 to 1.036 that correspond to 5.8% of the normalized frequency.

In the case of the presence of the common dielectric superstrate layer 16, the improvement of the antenna element performance can be seen when compared to the case without the superstrate layer. In particular, a VSWR is less than 1.5:1 in the range of 0.977 to 1.030 that correspond to 5.3% of the normalized frequency $F/F_0$, and less than 2.0:1 in the range of 0.965 to 1.070 that correspond to 10.5% of the normalized frequency.

Figure 3A:
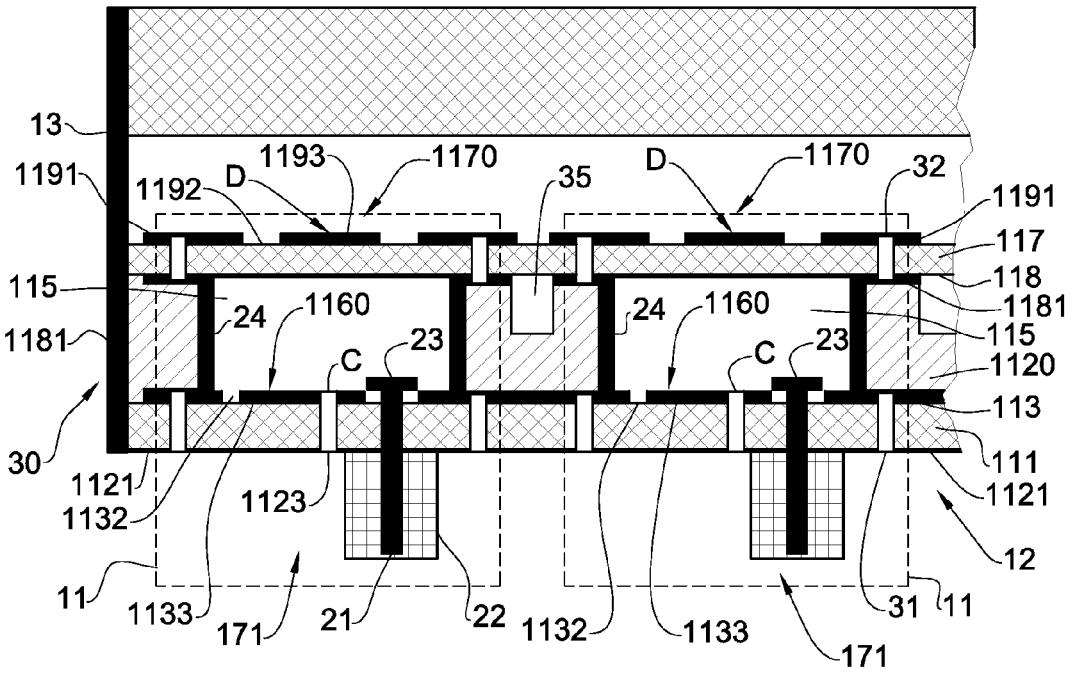
FIG. 3A is a schematic side cross-sectional fragmentary view of the phased array antenna of FIG. 1A illustrating a side cross-sectional view of antenna elements, according to another embodiment of the present invention.
Figure 3B:
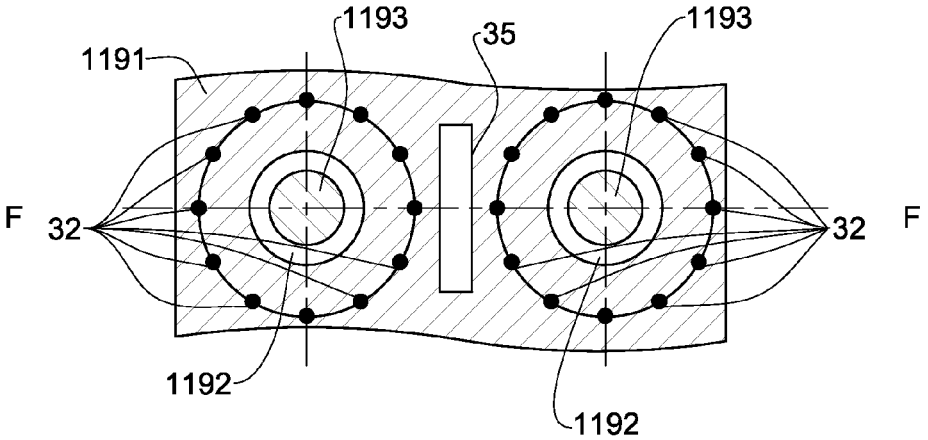
FIG. 3B illustrates a schematic transverse cross-sectional fragmentary view through B-B plane of FIG. 3A of an exemplar phased array antenna of the present invention.

Referring to FIGS. 3A and 3B together, schematic side and top fragmentary in cross-sectional views of the phased array antenna 30 are illustrated, according to another embodiment of the present invention. The antenna 30 differs from the antenna 10 shown in FIGS. 2A and 2B in the fact that the intermediate layer 1120 responsible for providing the desired distance between the staked radiating pair formed by the feeding radiator 1160 and the parasitic radiator 1170, is formed from a metal plate. This provision can enhance the superior structural rigidity and stability of the antenna structure. To fabricate the intermediate layer 1120, the metallic spacer plate is provided and then sieved by a through hole, thereby forming the antenna element cavity 115. According to this embodiment, the intermediate layer can, for example, be formed from aluminum to provide a lightweight structure, although other materials, e.g., zinc plated steel, can also be employed. Another difference of the antenna 30 from the antenna 10 shown in FIGS. 2A and 2B is in the fact that instead of the separating vias 33 and the separating notches 25 and 26, the phased array antenna 30 includes other separating notches 35 cut into the metallic intermediate layer 1120 between each neighboring pair of the elements 11 perpendicular to a plane F-F passing through the central loci points C and D. The purpose of the separating notches 35 is to reduce the inter-elements coupling occurring through the open air above the radiating elements plane. A length of the separating notches 35 can, for example, be in the range of $0.1\lambda_0$ to $\lambda_0/2$. The cavity formed by the notches 35 can be filled with a dielectric material having a relatively high dielectric constant, e.g., alumina. Although the other separating notches 35 with a flat bottom are shown in FIG. 3A, when desired, the other separating notches 35 can have any suitable shape, for example, the other separating notches 35 can be V-shaped notches, U-shaped notches, etc.

Although the feed arrangement 171 shown in FIG. 2A is in the form of a coaxial line (vertical probe), some other examples of implementations of the feed arrangement are shown herein below.

Figure 4A:
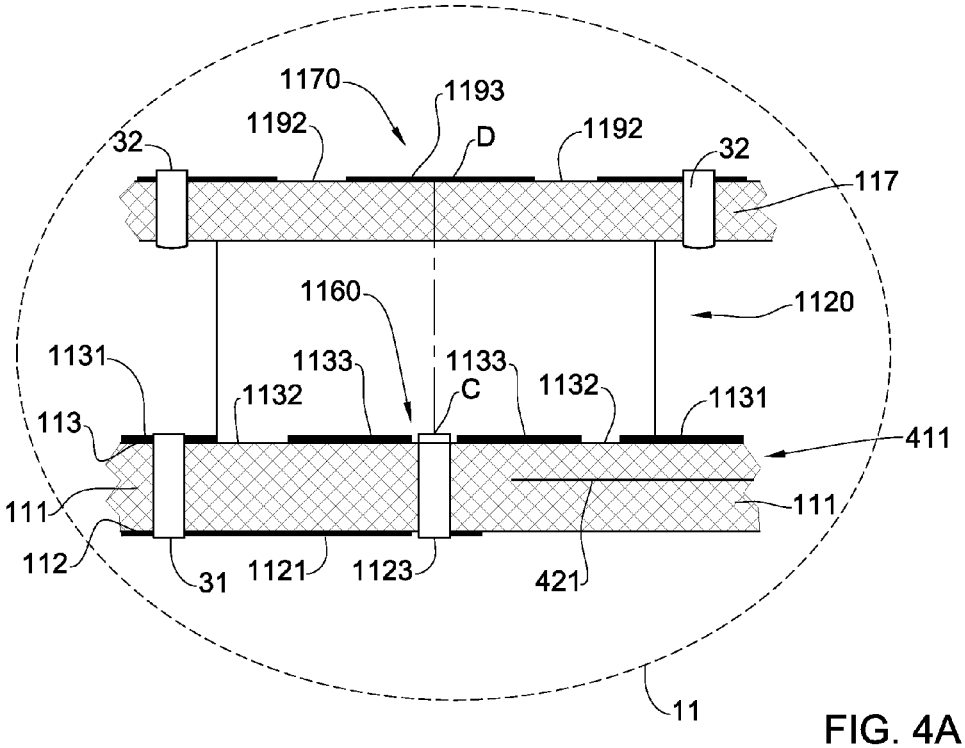
FIGS. 4A-4C illustrate cross-sectional fragmentary views of the antenna element of the present invention utilizing a feed arrangement, according to a further various embodiments.

Referring to FIG. 4A, a cross-sectional fragmentary view of the antenna element 11 of the present invention utilizing another implementation of feed arrangement 411 is illustrated. According to this example, the feed arrangement 411 includes an embedded microstrip feed line 421 arranged within the bottom dielectric substrate 111 that provides capacitive coupling to transfer RF energy between the embedded microstrip feed line 421 and the bottom feeding patch 1133. Each antenna element 11 in the phased array antenna can be fed by its own embedded microstrip feed line 421. As shown in FIG. 4A, the embedded microstrip feed line 421 is arranged within the dielectric substrate 111. In this case, the lower bottom coating 1121 has an area free from the metal under the embedded microstrip feed line 421.

The embedded microstrip feed line 421 can be fed from a cable (not shown), and can be of such configuration that provides a suitable matching circuit between the cable and the patch. For example, the cable can be a semi-rigid coaxial cable that can be soldered to microstrip metal of the embedded microstrip feed line 421. The microstrip metal can, for example, be a copper alloy.

Figure 4B:
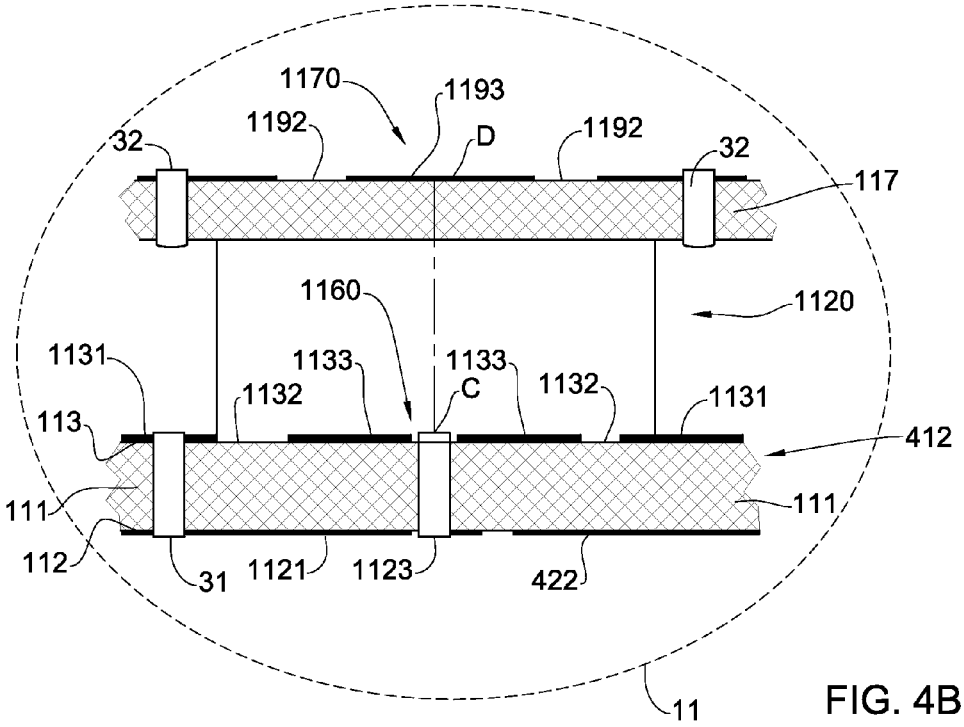

FIG. 4B shows a cross-sectional fragmentary view of the antenna element 11 of the present invention utilizing a feed arrangement 412, according to another embodiment. The embodiment shown in FIG. 4B differs from the embodiment shown in FIG. 4A in the fact that the feed arrangement 412 includes a microstrip feed line 422 which is arranged on the bottom substrate underside 112 of the bottom dielectric substrate 111. The microstrip feed line 422 can, for example, be adhesively bound to the bottom substrate underside 112. The microstrip feed line 422 provides capacitive coupling to transfer RF energy between the microstrip feed line 422 and the bottom feeding patch 1133.

Figure 4C:
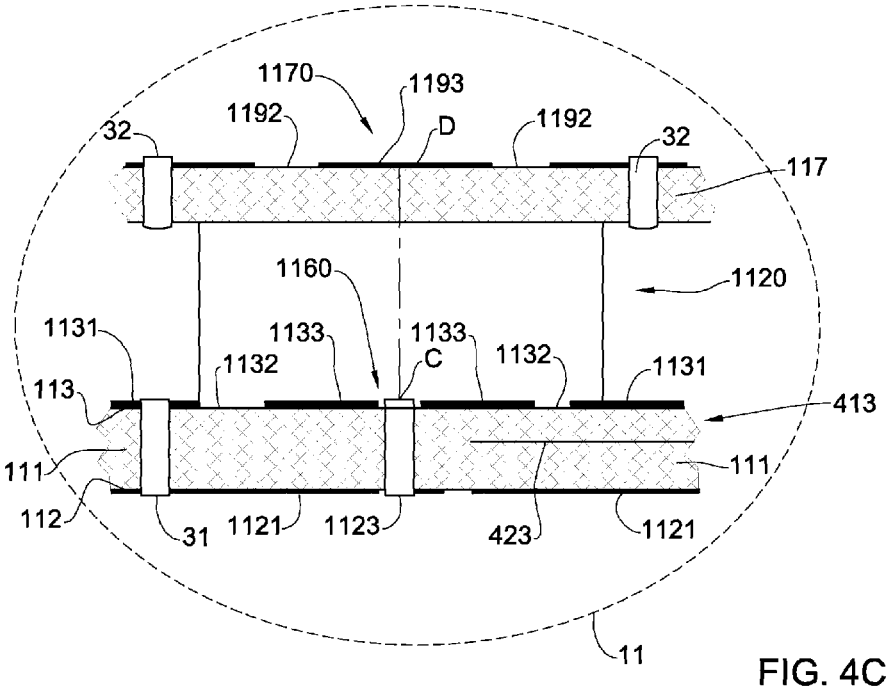

Referring to FIG. 4C, a cross-sectional fragmentary view of the antenna element 11 of the present invention utilizing another implementation of feed arrangement 413 is illustrated according to still another embodiment. The embodiment shown in FIG. 4C differs from the embodiment shown in FIG. 4A in the fact that the feed arrangement 413 includes a strip feed line 423 rather than an embedded microstrip feed line. As shown in FIG. 4C, in this case the lower bottom coating 1121 fully covers the bottom substrate underside 112, i.e. including the area under the strip feed line 423.

It should be noted that the configurations of the antenna shown in FIG. 4A through FIG. 4C can provide linear polarization (either vertical or horizontal). Nevertheless, circular or elliptical polarization implementation can also be achieved by providing two embedded microstrip feed lines (not shown) arranged within the dielectric substrate 111, which can be fed by two orthogonally phased (90° shifted) signals.

Still another implementation for providing circular/elliptical polarization with the antenna element described above can be a radiating element with a single strip feed line or a single microstrip feed line configured for providing circular/elliptical polarization. As described above, circular/elliptical polarization can be archived by a suitable configuration of the radiating patch. Examples of the radiating patch providing circular/elliptical include, but are not limited to, a triangular shaped patch, a rectangular shaped, a mainly circular patch which has a slightly perturbed circular shape, etc.

Figure 5A:
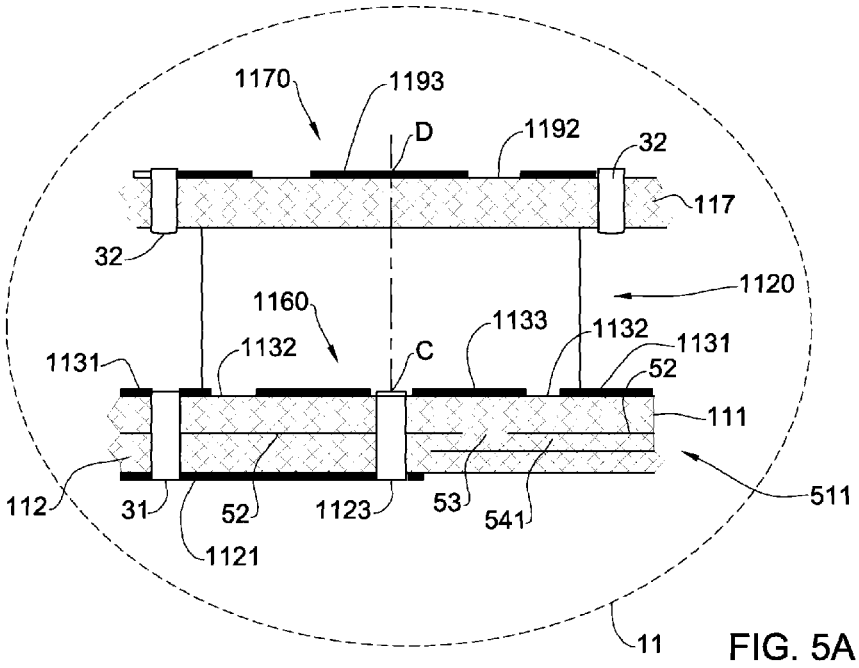
FIGS. 5A-5C illustrate cross-sectional fragmentary views of the antenna element of the present invention utilizing a feed arrangement, according to yet further embodiments.

Referring to FIG. 5A, a cross-sectional fragmentary view of the antenna element 11 of the present invention utilizing still another implementation of feed arrangement 511 is illustrated. According to this embodiment, the antenna element 11 includes a grounded layer 52 of conductive material arranged within the bottom dielectric substrate 111. The grounded layer 52 includes an opening 53 arranged under the bottom feeding patch 1133. The feed arrangement 511 includes an embedded microstrip feed line 541 arranged within the bottom dielectric substrate 111 that provides capacitive coupling to transfer RF energy between the embedded microstrip feed line 541 and the bottom feeding patch 1133 through the opening 53. In this case, the lower bottom coating 1121 has an area free from the metal under the embedded microstrip feed line 541.

The amount of contactless coupling from the microstrip feed line 541 to the patch 1133 is determined by the shape, size and location of the opening 53. It should be understood by a person versed in the art that the feed arrangements 511 may include more than one opening 53. In addition, openings 53 may generally be of any shape, such as polygonal, circular and/or elliptical, that provides desired coupling between the microstrip feed line 541 and the patch 1133.

Figure 5B:
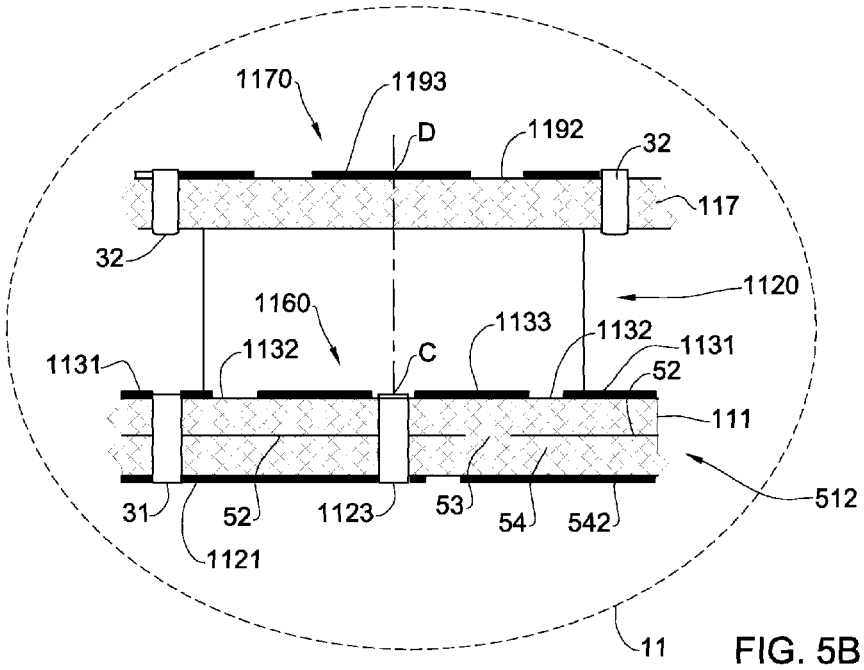

FIG. 5B shows a cross-sectional fragmentary view of the antenna element 11 of the present invention utilizing a feed arrangement 512, according to another embodiment. The embodiment shown in FIG. 5B differs from the embodiment shown in FIG. 5A in the fact that the feed arrangement 512 includes a microstrip feed line 542 which is arranged on the bottom substrate underside 112. The microstrip feed line 542 can, for example, be adhesively bound to the bottom substrate underside 112 of the bottom dielectric substrate 111. The microstrip feed line 542 provides capacitive coupling to transfer RF energy between the microstrip feed line 542 and the bottom feeding patch 1133 through the opening 53.

Figure 5C:
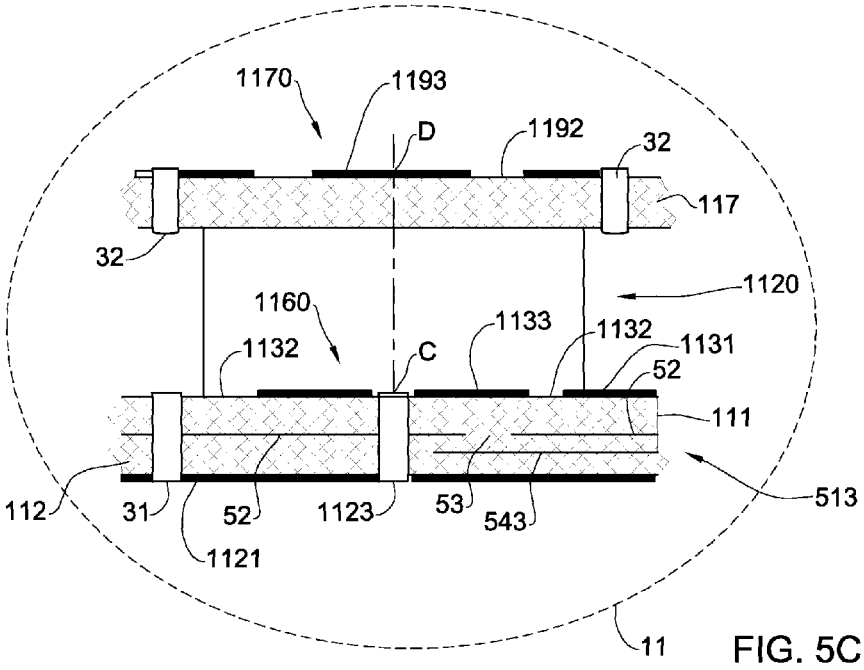

Referring to FIG. 5C, a cross-sectional fragmentary view of the antenna element 11 of the present invention utilizing another implementation of feed arrangement 513 is illustrated according to yet an embodiment. The embodiment shown in FIG. 5C differs from the embodiment shown in FIG. 5A in the fact that the feed arrangement 513 includes a strip feed line 543 rather than an embedded microstrip feed line. As shown in FIG. 5C, in this case the lower bottom coating 1121 fully covers the bottom substrate underside 112, i.e. including the area under the strip feed line 543. As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

The antenna of the present invention may be utilized in various inter systems, e.g., in communication within the computer wireless LAN (Local Area Network), PCN (Personal Communication Network) and ISM (Industrial, Scientific, Medical Network) systems.

The antenna may also be utilized in communications between a LAN and cellular phone network, GPS (Global Positioning System) or GSM (Global System for Mobile communication).

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present description.

The invention claimed is:

1. A phased array antenna comprising:

a plurality of antenna elements sharing a common conductive ground plane for the plurality of antenna elements and spaced apart at a predetermined distance from each other;

a common conductive shell electrically coupled to said common conductive ground plane and extending away there from to encompass said plurality of the antenna elements, wherein said common conductive shell and said common conductive ground plane together define a common cavity having a common aperture;

a common dielectric superstrate layer disposed over said common cavity at a predetermined distance from said plurality of the antenna elements; and a beam steering system coupled to said plurality of the antenna elements and configured for steering an energy beam produced by said phased array antenna, wherein for deflection angles θ of the radiation beam varied in the range of 0 to 70 degrees a minimal height $L_g$ of a gap in the common cavity between said common superstrate layer and a top of said plurality of antenna elements is $0.45\lambda_g$, where $\lambda_g=\lambda_0/\sqrt{\in_g}$, $\in_g$ is the dielectric permittivity of the gap, and $\lambda_0$ is the wavelength corresponding to the central operation frequency of said phased array antenna.

2. The phased array antenna of claim 1, wherein walls of said common conductive shell are perpendicular to said common conductive ground plane.

3. The phased array antenna of claim 1, wherein walls of said common conductive shell are tilted with respect to said common conductive ground plane.

4. The phased array antenna of claim 1, wherein said common dielectric superstrate layer is arranged at the common aperture of the common cavity.

5. The phased array antenna of claim 1, wherein the height $L_g$ of the gap in the common cavity between said common superstrate layer and the top of said plurality of antenna elements has a predetermined value that complies with a relationship:

$$L_g \approx \begin{cases} \lambda_g\left(x+\frac{n}{2}\right), & \text{where } 0.6 \le x \le 0.65 \quad \text{for } 0^\circ \le \theta \le 15^\circ \\ \lambda_g(0.01\theta+0.327+0.6n), & \text{for } 15^\circ < \theta \le 45^\circ, \\ y\lambda_g, & \text{where } 0.45 \le y \le 0.5 \quad \text{for } 45^\circ < \theta \le 70^\circ \end{cases}$$

where "n=0, 1, 2, . . . ".

6. A phased array antenna comprising:

a plurality of antenna elements sharing a common conductive ground plane for all the antenna elements and spaced apart at a predetermined distance from each other;

a common conductive shell electrically coupled to said common conductive ground plane and extending away there from to encompass said plurality of the antenna elements, wherein said common conductive shell and said common conductive ground plane together define a common cavity having a common aperture;

a common dielectric superstrate layer disposed over said common cavity at a predetermined distance from said plurality of the antenna elements; and a beam steering system coupled to said plurality of the antenna elements and configured for steering an energy beam produced by said phased array antenna, wherein a thickness of said common dielectric superstrate layer is uniform and has a predetermined value that complies with a relationship $L_{SL}=\lambda_{SL}(0.2+n/2)$, where $\lambda_{SL}=\lambda_0/\sqrt{\in_{SL}}$, and $\lambda_0$ is the wavelength corresponding to the central operation frequency of said phased array antenna, $\in_{SL}$ is the dielectric permittivity of said common dielectric superstrate layer, and "n=0, 1, 2, . . . ".

7. A phased array antenna comprising:

a plurality of antenna elements sharing a common conductive ground plane for all the antenna elements and spaced apart at a predetermined distance from each other;

a common conductive shell electrically coupled to said common conductive ground plane and extending away there from to encompass said plurality of the antenna elements, wherein said common conductive shell and said common conductive ground plane together define a common cavity having a common aperture;

a common dielectric superstrate layer disposed over said common cavity at a predetermined distance from said plurality of the antenna elements; and a beam steering system coupled to said plurality of the antenna elements and configured for steering an energy beam produced by said phased array antenna, wherein a thickness of said common dielectric superstrate layer near walls of said common conductive shell is different than a thickness of said common dielectric superstrate layer at its center.

8. A phased array antenna comprising:

a plurality of antenna elements sharing a common conductive ground plane for the plurality of antenna elements and spaced apart at a predetermined distance from each other;

a common conductive shell electrically coupled to said common conductive ground plane and extending away there from to encompass said plurality of the antenna elements, wherein said common conductive shell and said common conductive ground plane together define a common cavity having a common aperture;

a common dielectric superstrate layer disposed over said common cavity at a predetermined distance from said plurality of the antenna elements; and a beam steering system coupled to said plurality of the antenna elements and configured for steering an energy beam produced by said phased array antenna;

wherein each antenna element of said plurality of antenna elements comprises a vertically stacked structure comprising:

an antenna element conductive shell extending away from and coupled to said common conductive ground plane, said antenna element conductive shell having an antenna element cavity having a bottom and an antenna element aperture;

a feeding radiator arranged at the bottom of the antenna element cavity and disposed over said common conductive ground plane;

a parasitic radiator backed by the cavity and parasitically coupled to said feeding radiator, said parasitic radiator being disposed over and spaced apart from said feeding radiator, and a feed arrangement coupled to the feeding radiator and operable to provide radio frequency energy thereto;

wherein each antenna element includes a bottom dielectric substrate having a bottom substrate underside covered with a lower bottom conductive coating adhesively bound thereto, and a bottom substrate upper side covered with an upper bottom conductive coating adhesively bound thereto; wherein said lower bottom conductive coating and said upper bottom conductive coating are grounded; thereby forming said common conductive ground plane; wherein said conductive shell of each antenna element is connected to said upper bottom conductive coating.

9. The phased array antenna of claim 8, wherein said feeding radiator includes a bottom slot arranged within the cavity in said upper bottom conductive coating to define a bottom feeding patch encompassed by the bottom slot, and the bottom feeding patch can be galvanically and electromagnetically grounded by an electrically conductive via at a central loci point of the bottom feeding patch.

10. A phased array antenna comprising:

a plurality of antenna elements sharing a common conductive ground plane for the plurality of antenna elements and spaced apart at a predetermined distance from each other;

a common conductive shell electrically coupled to said common conductive ground plane and extending away there from to encompass said plurality of the antenna elements, wherein said common conductive shell and said common conductive ground plane together define a common cavity having a common aperture;

a common dielectric superstrate layer disposed over said common cavity at a predetermined distance from said plurality of the antenna elements; and a beam steering system coupled to said plurality of the antenna elements and configured for steering an energy beam produced by said phased array antenna;

wherein each antenna element of said plurality of antenna elements comprises a vertically stacked structure comprising:

an antenna element conductive shell extending away from and coupled to said common conductive ground plane, said antenna element conductive shell having an antenna element cavity having a bottom and an antenna element aperture;

a feeding radiator arranged at the bottom of the antenna element cavity and disposed over said common conductive ground plane;

a parasitic radiator backed by the cavity and parasitically coupled to said feeding radiator, said parasitic radiator being disposed over and spaced apart from said feeding radiator, and a feed arrangement coupled to the feeding radiator and operable to provide radio frequency energy thereto;

wherein each antenna element includes a top dielectric substrate common for the plurality of antenna elements, said top dielectric substrate having a top substrate underside having a lower top coating adhesively bound thereto, and a top substrate upper side having an upper top coating adhesively bound thereto, said lower top coating being connected to said antenna element conductive shell.

11. The phased array antenna of claim 10, wherein said parasitic radiator includes a top slot in said upper top coating to define a top radiating patch encompassed by the top slot.

12. The phased array antenna of claim 10, wherein said parasitic radiator includes a top slot arranged within the cavity in said lower top coating to define a top radiating patch encompassed by the top slot.

13. The phased array antenna of claim 10, wherein each antenna element further comprises an intermediate layer sandwiched between a bottom dielectric substrate and the top dielectric substrate for providing a vertical separation and support to the bottom dielectric substrate and the top dielectric substrate.

14. A phased array antenna comprising:

a plurality of antenna elements sharing a common conductive ground plane for all the antenna elements and spaced apart at a predetermined distance from each other;

a common conductive shell electrically coupled to said common conductive ground plane and extending away there from to encompass said plurality of the antenna elements, wherein said common conductive shell and said common conductive ground plane together define a common cavity having a common aperture;

a common dielectric superstrate layer disposed over said common cavity at a predetermined distance from said plurality of the antenna elements; and a beam steering system coupled to said plurality of the antenna elements and configured for steering an energy beam produced by said phased array antenna, wherein each antenna element of said plurality of antenna elements comprises a vertically stacked structure comprising:

a bottom dielectric substrate having a bottom substrate underside having a lower bottom conductive coating adhesively bound thereto, and a bottom substrate upper side having an upper bottom conductive coating adhesively bound thereto;

an antenna element conductive shell extending away from the bottom substrate upper side and connected to said upper bottom conductive coating, said antenna element conductive shell having an antenna element cavity having an antenna element aperture;

a feeding radiator including a bottom slot arranged within the cavity in said upper bottom conductive coating to define a bottom feeding patch encompassed by the bottom slot;

a top dielectric substrate common for all the antenna elements, said top dielectric substrate having a top substrate underside having a lower top coating adhesively bound thereto, and a top substrate upper side having an upper top coating adhesively bound thereto, said lower top coating being connected to said antenna element conductive shell;

a parasitic radiator backed by the cavity being disposed over and spaced apart from said feeding radiator, and parasitically coupled to said feeding radiator, said parasitic radiator including a top slot in said upper top coating to define a top radiating patch encompassed by the top slot;

a feed arrangement coupled to the feeding radiator and operable to provide radio frequency energy thereto; and an intermediate layer sandwiched between the bottom dielectric substrate and the top dielectric substrate for providing a vertical separation and support to the bottom dielectric substrate and the top dielectric substrate.

15. The phased array antenna of claim 14, further comprising a plurality of separating vias passing through at least the intermediate layer and the top dielectric substrate, and connecting the conductive upper bottom coating mounted on the bottom substrate upper side to the upper top coating mounted on the top substrate upper side.

16. The phased array antenna of claim 15, further comprising separating notches arranged between the separating vias and cut into the conductive lower top coating mounted on the top substrate underside and into the upper top coating mounted on the top substrate upper side, correspondingly.

17. The phased array antenna of claim 14, further comprising other separating notches cut into the intermediate layer between neighboring pairs of the elements.

18. An antenna element having a vertically stacked structure comprising:

a bottom dielectric substrate, said bottom dielectric substrate having a bottom substrate underside having a lower bottom conductive coating adhesively bound thereto, and a bottom substrate upper side having an upper bottom conductive coating adhesively bound thereto;

an antenna element conductive shell extending away from the bottom substrate upper side and connected to said upper bottom conductive coating, said antenna element conductive shell having an antenna element cavity having an antenna element aperture;

a feeding radiator including a bottom slot arranged within the cavity, in said upper bottom conductive coating to define a bottom feeding patch encompassed by the bottom slot;

a top dielectric substrate, said top dielectric substrate having a top substrate underside, having a lower top coating adhesively bound thereto, and a top substrate upper side having an upper top coating adhesively bound thereto, said lower top coating being connected to said antenna element conductive shell;

a parasitic radiator backed by the cavity being disposed over and spaced apart from said feeding radiator, and parasitically coupled to said feeding radiator, said parasitic radiator including a top slot in said upper top coating to define a top radiating patch encompassed by the top slot;

an antenna element feed arrangement coupled to the feeding radiator and operable to provide radio frequency energy thereto; and an intermediate layer sandwiched between the bottom dielectric substrate and the top dielectric substrate for providing a vertical separation and support to the bottom dielectric substrate and the top dielectric substrate.

19. The antenna element of claim 18, further comprising other separating notches cut into the intermediate layer between neighboring pairs of the elements.

* * * * *